US008078072B2

(12) United States Patent
Nanjo et al.

(10) Patent No.: US 8,078,072 B2
(45) Date of Patent: Dec. 13, 2011

(54) IMAGE FORMING APPARATUS WITH IMAGE FIXING DEVICE INCLUDING AN INDUCTION HEATER AND A SHIELD LOCATED BETWEEN TWO SECTIONS OF A CORE OF THE INDUCTION HEATER

(75) Inventors: Yuzuru Nanjo, Osaka (JP); Eiji Nakajima, Osaka (JP); Akihiro Kondo, Osaka (JP); Naoyuki Ishida, Osaka (JP); Syoukou Gon, Osaka (JP); Kenichi Kasama, Osaka (JP)

(73) Assignee: Kyocera Mita Corporation (JP)

( * ) Notice: Subject to any disclaimer, the term of this patent is extended or adjusted under 35 U.S.C. 154(b) by 457 days.

(21) Appl. No.: 12/323,537

(22) Filed: Nov. 26, 2008

(65) Prior Publication Data

US 2009/0175644 A1 Jul. 9, 2009

(30) Foreign Application Priority Data

Jan. 7, 2008 (JP) ..... 2008-000432
Jan. 10, 2008 (JP) ..... 2008-003203

(51) Int. Cl.
*G03G 15/20* (2006.01)

(52) U.S. Cl. ..... 399/67; 399/45; 219/216

(58) Field of Classification Search ..... 399/69, 399/45, 328; 219/216
See application file for complete search history.

(56) References Cited

U.S. PATENT DOCUMENTS 6,453,144 B1 * 9/2002 Sato ..... 399/328
6,687,481 B2 * 2/2004 Watanabe et al. ..... 399/328
7,835,680 B2 * 11/2010 Nanjo et al. ..... 399/329
7,890,042 B2 * 2/2011 Ishida et al. ..... 399/329
2007/0014599 A1 * 1/2007 Yasuda et al. ..... 399/328
2007/0014601 A1 1/2007 Yasuda et al.
2009/0175664 A1 * 7/2009 Nanjo et al. ..... 399/330
2009/0245898 A1 * 10/2009 Gon et al. ..... 399/328
2009/0245902 A1 * 10/2009 Gon et al. ..... 399/331
2009/0269109 A1 * 10/2009 Ishida et al. ..... 399/330
2010/0014900 A1 * 1/2010 Gon ..... 399/330
2010/0028061 A1 * 2/2010 Nanjo et al. ..... 399/328
2010/0046996 A1 * 2/2010 Nanjo et al. ..... 399/330
2010/0104334 A1 * 4/2010 Nanjo ..... 399/333
2010/0272482 A1 * 10/2010 Nanjo ..... 399/328
2010/0272483 A1 * 10/2010 Nanjo ..... 399/331
2011/0052281 A1 * 3/2011 Gon ..... 399/329

FOREIGN PATENT DOCUMENTS

JP 6-318001 11/1994
JP 2003-107941 4/2003
JP 3527442 2/2004

* cited by examiner

*Primary Examiner* — David Gray
*Assistant Examiner* — G. M. Hyder
(74) *Attorney, Agent, or Firm* — Gerald E. Hespos; Michael J. Porco

(57) ABSTRACT

An image forming apparatus has an image forming station and a fixing unit. The fixing unit includes a coil for generating a magnetic field for induction heating the heating member. A first core made of a magnetic material is arranged fixedly around the coil. A second core made of a magnetic material is between the first core and the heating member in a generation direction of the magnetic field to form a magnetic path in cooperation with the first core and capable of changing a posture thereof. A shield made of a nonmagnetic metal is arranged along the outer surface of the second core to shield magnetism in the magnetic field and a magnetic shielding portion for changing the posture of the second core between a first posture where the shield shields the magnetism and a second posture where the shield does not shield the magnetism.

18 Claims, 28 Drawing Sheets

MIDDLE-SMALL SIZE SHIELDING (120°)

IMAGE FORMING APPARATUS WITH IMAGE FIXING DEVICE INCLUDING AN INDUCTION HEATER AND A SHIELD LOCATED BETWEEN TWO SECTIONS OF A CORE OF THE INDUCTION HEATER

BACKGROUND OF THE INVENTION

1. Field of the Invention

The present invention relates to an image forming apparatus provided with a fixing unit for permitting a sheet bearing a toner image to pass between a heating member and a pressing member to heat and melt unfixed toner and fixe it to the sheet.

2. Description of the Related Art

In recent years, attention has been focused of belt-type image forming apparatuses, in which a smaller heat capacity can be set, due to demands of shortening a warm-up time and saving energy in a fixing unit (see, for example, Japanese Unexamined Patent Publication No. H06-318001). Attention has been also focused on an electromagnetic induction heating method (IH) with a possibility of quick heating and high efficiency heating in recent years, and many products as a combination of electromagnetic induction heating and the employment of a belt have commercialized in light of saving energy upon fixing a color image. In the case of combining the employment of a belt and electromagnetic induction heating, an electromagnetic induction device is often arranged at an outer side of the belt due to merits that a coil can be easily laid out and cooled and further the belt can be directly heated (so-called external IH).

In the above electromagnetic induction heating method, various technologies have been developed to prevent an excessive temperature increase in a sheet non-passage area in consideration of a sheet width (paper width) passed through the fixing unit. Particularly, the following prior arts are known as size switching means in the external IH.

A first prior art (Japanese Unexamined Patent Publication No. 2003-107941) discloses that a magnetic member is divided into a plurality of pieces, which are arranged in a sheet width direction, and some of the magnetic member pieces are moved toward or away from an exciting coil in accordance with the size of a sheet to be passed (paper width). In this case, heating efficiency decreases by moving the magnetic member pieces away from the exciting coil in sheet non-passage areas, and the amount of heat generation is thought to be less than in an area corresponding to a sheet with a minimum paper width.

A second prior art (Publication of Japanese Patent No. 3527442) discloses that other conductive members are arranged outside a minimum paper width in a heating roller and the positions thereof are switched between those inside and outside the extent of a magnetic field. According to the second prior art, the conductive members are first located outside the extent of the magnetic field to heat the heating roller by electromagnetic induction. If the temperature of the heating roller rises to the vicinity of a Curie temperature, the conductive members are moved to the extent of the magnetic field. Then, magnetic flux leaks from the heating roller at the outer sides of the minimum paper width, thereby preventing excessive temperature increases in the sheet non-passage areas.

However, the first prior art has a problem of inadvertently enlarging the entire apparatus since the movable range of the magnetic member is large and an extra space is, accordingly necessary. On the other hand, the second prior art can save space since the members for switching the size are arranged in the heating roller. However, the interior of the heating roller is a high-temperature environment and it is necessary to set a high Curie temperature in the case of arranging a certain member therein. Above all, a member with large heat capacity has a problem of extending a warm-up time.

SUMMARY OF THE INVENTION

An object of the present invention is to provide an image forming apparatus capable of promoting lower heat capacity, reducing a warm-up time and realizing space saving by reducing the number of members arranged in a heating member.

In order to accomplish this object, one aspect of the present invention is directed to an image forming apparatus, comprising an image forming station for transferring a toner image to a sheet; and a fixing unit including a heating member and a pressing member and adapted to convey the sheet while sandwiching the sheet between the heating member and the pressing member and to fix the toner image to the sheet by heat at least from the heating member in a conveyance process, wherein the fixing unit includes a coil for generating a magnetic field for induction heating the heating member; a first core made of a magnetic material and fixedly arranged around the coil to form a magnetic path around the coil; a second core made of a magnetic material, arranged between the first core and the heating member in a generation direction of the magnetic field by the coil to form the magnetic path in cooperation with the first core and capable of changing a posture thereof; a shielding member made of a nonmagnetic metal and arranged along the outer surface of the second core to shield magnetism in the magnetic field generated by the coil; and a magnetic shielding portion for changing the posture of the second core between a first posture where the shielding member shields the magnetism and a second posture where the shielding member does not shield the magnetism.

DETAILED DESCRIPTION OF THE PREFERRED EMBODIMENTS

Hereinafter, embodiments of the present invention are described in detail with reference to the accompanying drawings.

Figure 1:
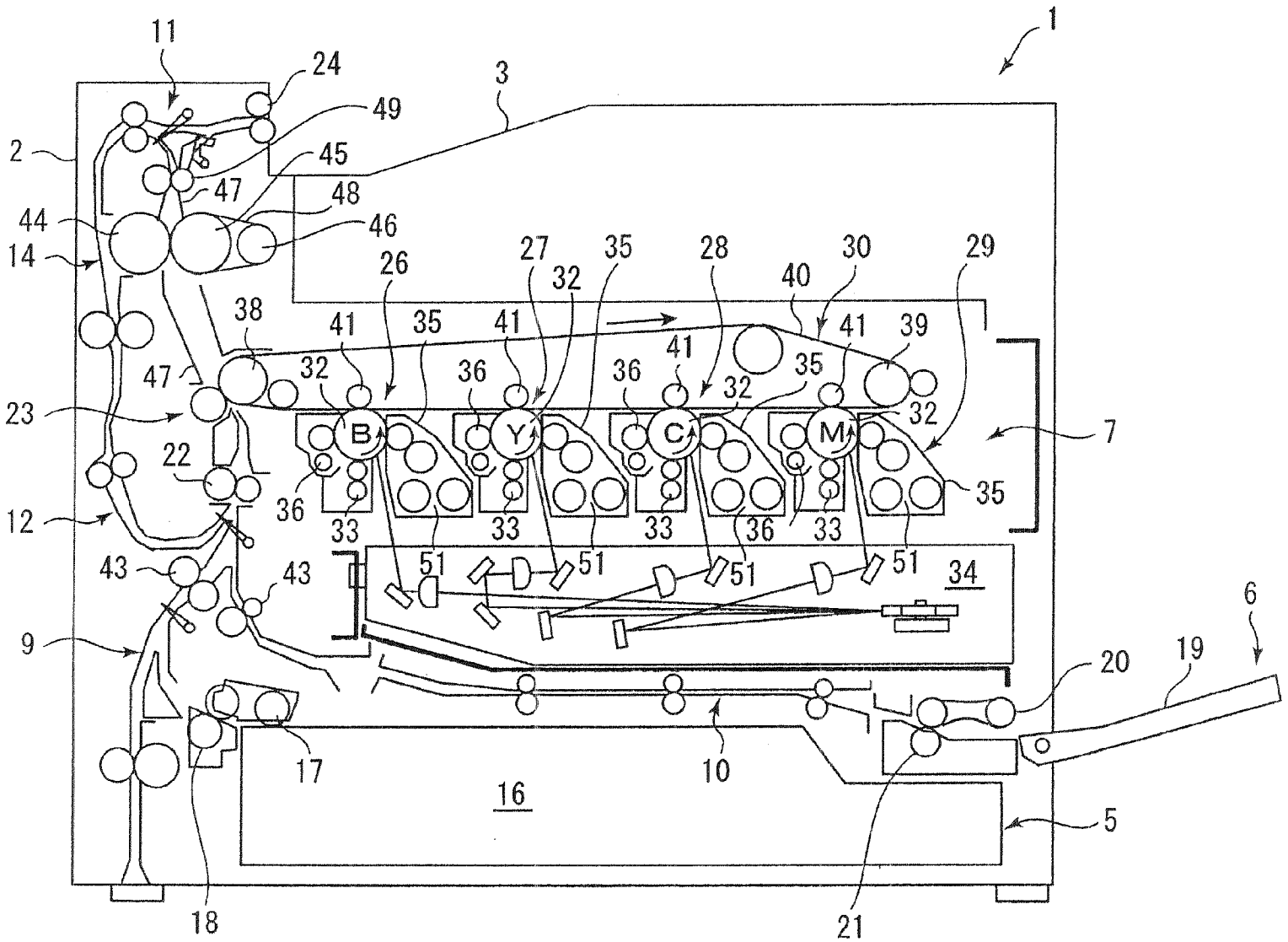
FIG. 1 is a schematic diagram showing the construction of an image forming apparatus according to one embodiment of the invention.

FIG. 1 is a schematic diagram showing the construction of an image forming apparatus 1 according to one embodiment of the present invention. The image forming apparatus 1 can be a printer, a copier, a facsimile machine, a complex machine of these functions or the like for printing by transferring a toner image to the surface of a print medium such as a print sheet, for example, in accordance with externally inputted image information.

The image forming apparatus 1 shown in FIG. 1 is a tandem color printer. This image forming apparatus 1 is provided with an apparatus main body 2 in the form of a rectangular box for forming (printing) a color image on a sheet inside. A sheet discharge unit (discharge tray) 3 for discharging a sheet having a color image printed thereon is provided in a top part of the apparatus main body 2.

A sheet cassette 5 for storing sheets is arranged at the bottom in the interior of the apparatus main body 2, a stack tray 6 for manually feeding a sheet is arranged in an intermediate part, and an image forming station 7 is arranged in an upper part. The image forming station 7 forms (transfers) a toner image on a sheet based on image data such as characters and pictures transmitted from the outside of the apparatus.

A first conveyance path 9 for conveying a sheet dispensed from the sheet cassette 5 to the image forming station 7 is arranged in a left part of the apparatus main body 2 in FIG. 1, and a second conveyance path 10 for conveying a sheet dispensed from the stack tray 6 to the image forming station 7 is arranged from a right side to the left side. Further, a fixing unit 14 for performing a fixing process to a sheet having an image formed thereon in the image forming station 7 and a third conveyance path 11 for conveying the sheet finished with the fixing process to the sheet discharging unit 3 are arranged in a left upper part in the apparatus main body 2.

The sheet cassette 5 enables the replenishment of sheets by being withdrawn toward the outside (e.g. toward front side in FIG. 1) of the apparatus main body 2. This sheet cassette 5 includes a storing portion 16, which can selectively store at least two types of sheets having different sizes in a sheet feeding direction. Sheets stored in the storing portion 16 are dispensed one by one toward the first conveyance path 9 by a feed roller 17 and separation rollers 18.

The stack tray 6 can be opened and closed relative to an outer surface of the apparatus main body 2, and sheets to be manually fed are placed one by one or a plurality of sheets are placed on a manual feeding portion 19. Sheets placed on the manual feeding portion 19 are dispensed one by one toward the second conveyance path 10 by a pickup roller 20 and separation rollers 21.

The first conveyance path 9 and the second conveyance path 10 join before registration rollers 22. A sheet fed to the registration rollers 22 temporarily waits on standby here and is conveyed toward a secondary transfer unit 23 after a skew adjustment and a timing adjustment. A full color toner image on an intermediate transfer belt 40 is secondarily transferred to the conveyed sheet in the secondary transfer unit 23. Thereafter, the sheet having the toner image fixed in the fixing unit 14 is reversed in a fourth conveyance path 12 if necessary, so that a full color toner image is secondarily transferred also to the opposite side of the sheet in the secondary transfer unit 23. After the toner image on the opposite side is fixed in the fixing unit 14, the sheet is discharged to the sheet discharging unit 3 by discharge rollers 24 through the third conveyance path 11.

The image forming station 7 includes four image forming units 26, 27, 28 and 29 for forming toner images of black (B), yellow (Y), cyan (C) and magenta (M) and an intermediate transfer unit 30 for bearing the toner images of the respective colors formed in the image forming units 26 to 29 in a superimposed manner.

Each of the image forming units 26 to 29 includes a photoconductive drum 32, a charger 33 arranged to face the circumferential surface of the photosensitive drum 32, a laser scanning unit 34 arranged downstream of the charger 33 for emitting a laser beam to a specific position on the circumferential surface of the photosensitive drum 32, a developing device 35 arranged to face the circumferential surface of the photosensitive drum 32 downstream of a laser beam emission position from the laser scanning unit 34 and a cleaning device 36 arranged downstream of the developing device 35 to face the photosensitive drum 32.

The photosensitive drum 32 of each of the image forming units 26 to 29 is rotated in a counterclockwise direction of FIG. 1 by an unillustrated drive motor. Black toner, yellow toner, cyan toner and magenta toner are respectively contained in toner boxes 51 of the developing devices 35 of the respective image forming units 26 to 29.

The image transfer unit 30 includes a drive roller 38 arranged at a position near the image forming unit 26, a driven roller 39 arranged at a position near the image forming unit 29, an intermediate transfer belt 40 mounted on the drive roller 38 and the driven roller 39 and four transfer rollers 41 arranged in correspondence with the photosensitive drums 32 of the respective image forming units 26 to 29. The respective transfer rollers 41 are arranged at positions downstream of the developing devices 35 of the corresponding image forming units 26 to 29 such that they can be pressed into contact with the photosensitive drum 32 via the intermediate transfer belt 40.

In this image transfer unit 30, the toner images of the respective colors are transferred in a superimposition manner on the intermediate transfer belt 40 at the positions of the transfer rollers 41 of the respective image forming units 26 to 29. As a result, a full color toner image is finally formed on the intermediate transfer belt 40.

The first conveyance path 9 conveys a sheet dispensed from the sheet cassette 5 toward the image transfer unit 30. The first conveyance path 9 includes a plurality of conveyor rollers 43 arranged at specified positions in the apparatus main body 2 and the registration rollers 22 arranged before the image transfer unit 30 for timing an image forming operation and a sheet feeding operation in the image forming station 7.

The fixing unit 14 fixes an unfixed toner image to a sheet by heating and pressing the sheet having the toner image transferred thereto in the image forming station 7. The fixing unit 14 includes a pair of rollers comprised of a heating pressure roller 44 (pressing member) and a fixing roller 45. The pressure roller 44 is a metallic roller, and the fixing roller 45 is comprised of a metallic core material, an outer layer (e.g. silicon sponge) made of elastic material and a mold releasing layer (e.g. PFA). Further, a heat roller 46 is disposed adjacent to the fixing roller 45, and a heating belt 48 (heating member) is mounted on this heat roller 46 and the fixing roller 45. A detailed structure of the fixing unit 14 is described later.

Conveyance paths 47 are arranged upstream and downstream of the fixing unit 14 in a sheet conveying direction. A sheet conveyed through the image transfer unit 30 is introduced to a nip between the pressure roller 44 and the fixing roller 45 (heating belt 48) via the upstream conveyance path 47. The sheet having passed between the pressure roller 44 and the fixing roller 45 is guided to the third conveyance path 11 via the downstream conveyance path 47.

The third conveyance path 11 conveys the sheet finished with the fixing process in the fixing unit 14 to the sheet discharging unit 3. Thus, conveyer rollers 49 are arranged at a suitable position in the third conveyance path 11 and the above discharge rollers 24 are arranged at the exit of the third conveyance path 11.

<First Embodiment of the Fixing Unit>

Next, the fixing unit 14 according to a first embodiment employed in the above image forming apparatus 1 is described in detail.

Figure 2:
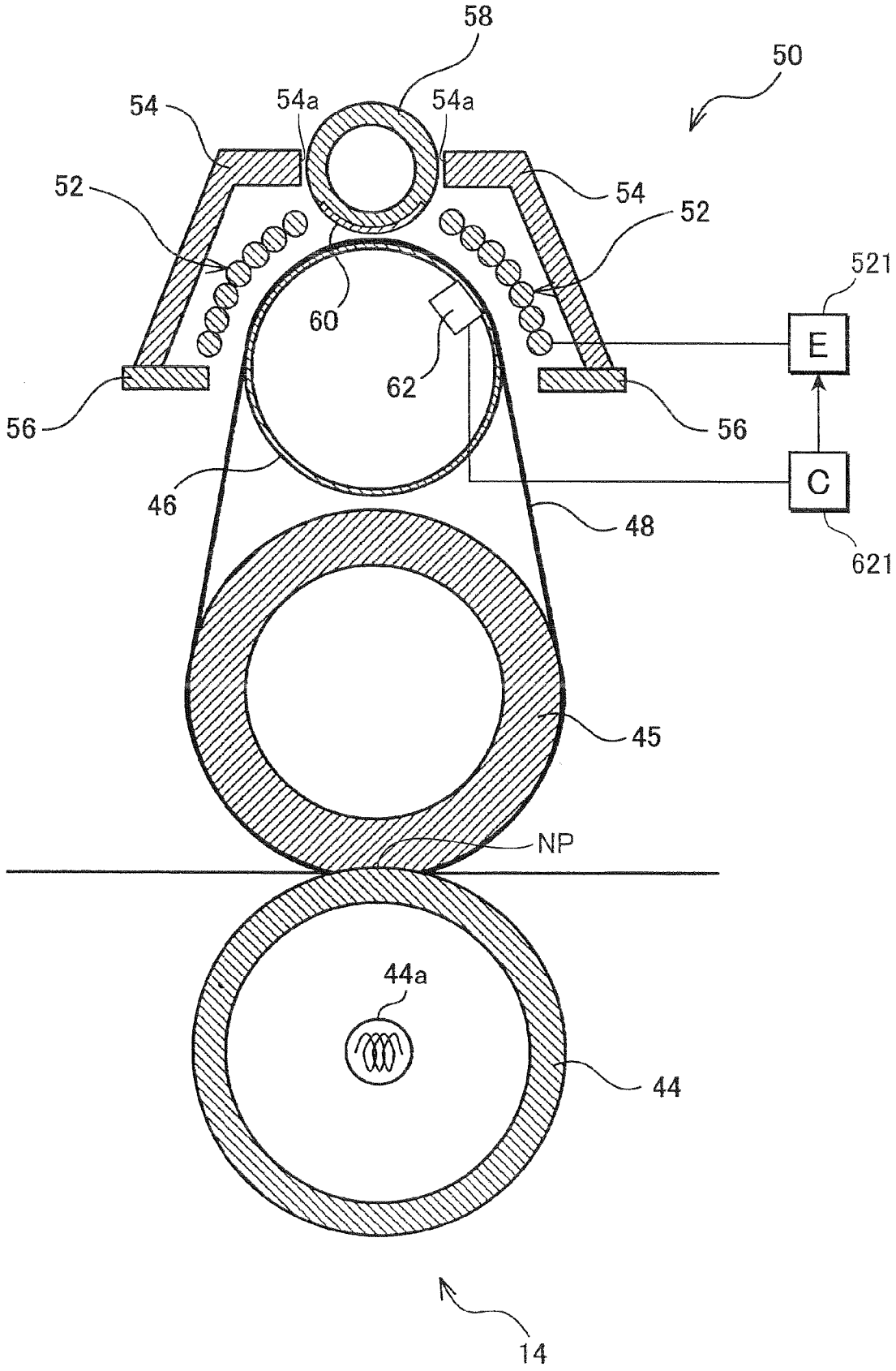
FIG. 2 is a vertical section showing the structure of a fixing unit according to a first embodiment of the invention.

FIG. 2 is a vertical section showing the structure of the fixing unit 14 of the first embodiment. In a state shown in FIG. 2, the orientation of the fixing unit 14 is rotated counterclockwise by about 90° from an actually mounted state in the image forming apparatus 1. Accordingly, the sheet conveying direction from lower side to upper side in FIG. 1 is from right side to left side in FIG. 2. If the apparatus main body 2 has a larger size (complex machine or the like), the fixing unit 14 may be actually mounted in the orientation shown in FIG. 2.

The fixing unit 14 includes the pressure roller 44, the fixing roller 45, the heat roller 46 and the heating belt 48 as described above. The pressure roller 44 is made of a metal, but the fixing roller 45 includes the elastic layer of silicon sponge on the outer layer. Thus, a flat nip NP is formed between the heating belt 48 and the fixing roller 45. It should be noted that a halogen heater 44*a* is disposed in the pressure roller 44. A base member of the heating belt 48 is made of a ferromagnetic material (e.g. Ni), a thin elastic layer (e.g. silicon rubber) is formed on the outer surface of the base member, and the mold releasing layer (e.g. PFA) is formed on the outer surface of the elastic layer. A core of the heat roller 46 is made of a magnetic metal (e.g. Fe) and a mold releasing layer (e.g. PFA) is formed on the outer surface of the core.

The fixing unit 14 conveys the sheet while holding it in a nip NP between the pressure roller 44 and the fixing roller 45 via the heating belt 48. In this conveyance process, the sheet receives heat from the pressure roller 45 and the heating belt 48, whereby the toner image transferred onto the sheet is fixed to the sheet.

The fixing unit 14 further includes an IH coil unit 50 at an outer side of the heat roller 46 and the heating belt 48 (not shown in FIG. 1). The IH coil unit 50 includes an induction heating coil 52 (coil), a pair of arch cores 54 (part of a first core), a pair of side cores 56 (part of the first core) and a center core 58 (second core).

[Coil]

As shown in FIG. 2, the induction heating coil 52 is arranged on a virtual arcuate surface extending along an arcuate outer surface for induction heating in arcuate parts of the heat roller 46 and the heating belt 48. Further, the induction heating coil 52 extends in a longitudinal direction of the heat roller 46 (see FIG. 4A) and substantially entirely covers the heat roller 46 in the longitudinal direction. Actually, an unillustrated resin cover is arranged at the outer side of the heat roller 46 and the heating belt 48 and the induction heating coil 52 is wound around this resin cover.

[First Core]

The center core 58 is located in the center in FIG. 2, and the arch cores 54 and the side cores 56 are arranged in pairs at the opposite sides of the center core 58. The arch cores 54 at the opposite sides are cores made of ferrite and formed to have arched cross sections symmetrical with each other, and the entire lengths thereof are longer than a winding area of the induction heating coil 52. The side cores 56 at the opposite sides are cores made of ferrite and having a block shape. The side cores 56 at the opposite sides are connected with one ends (bottom ends in FIG. 2) of the corresponding arch cores 54 and cover the outer side of the wining area of the induction heating coil 52. The arch cores 54 and the side cores 56 are, for example, fixedly arranged at a plurality of positions spaced apart in the longitudinal direction of the heating roller 46. The arrangement of the cores 54, 56 are, for example, determined in accordance with a magnetic flux density (magnetic field intensity) of the induction heating coil 52.

[Temperature Controller]

In the example of FIG. 2, a temperature controller includes a thermistor 62 (temperature responding element) and a temperature control circuit 621. The thermistor 62 is disposed inside the heat roller 46 to detect the temperature of the heat roller 46. One or more thermistors 62 can be disposed at positions in the heating roller 46 where the amount of heat generation by induction heating is particularly large. In the construction of the first embodiment, the thermistor 62 is desirably disposed at an inner side facing a longitudinal central position (in a later-described area of a minimum paper width W1 shown in FIG. 3) of the heating roller 46.

The temperature control circuit 621 provided in the image forming apparatus 1 controls a power supply device 521 of alternating current power supplied to the induction heating coil 52 based on the temperature detected by the thermistor 62. The temperature control circuit 621 controls the alternating current power supplied from the power supply device 521 to the induction heating coil 52 such that a temperature T detected by the thermistor 62 is maintained at a target temperature Ta necessary to fix a toner image to a sheet. This control may be performed by on-off controlling the power supply device 521. Alternatively, a control to be executed may be such that the amount of alternating current power supplied to the induction heating coil 52 is increased and decreased by changing the voltage and/or frequency of the alternating current power generated by the power supply device 521.

One or more thermostats (temperature responding elements) may be disposed inside the heating roller 46. The thermostat can be disposed at positions in the heating roller 46 where the amount of heat generation by induction heating is particularly large and operate in response to an excessive temperature increase of the heating roller 46 to stop the heating by the induction heating coil 52.

[Second Core]

The center core 58 is a core made of ferrite and having a tubular shape. Substantially similar to the heating roller 46, the center core 58 has a length corresponding to the maximum paper width (width of maximum size sheets out of sheets conveyed by the fixing unit 14). Although not shown in FIG. 2, the center core 58 is connected with a rotating mechanism (see FIG. 4A) and made rotatable about its longitudinal axis by this rotating mechanism. The center core 58 may have a cylindrical shape.

The center core 58 is arranged between the arch cores 54 and the heating roller 46 (heating belt 48), when seen in a generation direction of a magnetic field by the induction heating coil 52, in order to form magnetic paths together with the arch cores 54 and the side cores 56. More specifically, ends 54*a* (entrances or exits of the magnetic paths) of the arch cores 54 are distant from the heating belt 48, but the center core 58 is a member for forming intermediate magnetic paths between the ends 54*a* and the heating belt 48.

[Shielding Member]

shielding members 60 are mounted on the center core 58 along its outer surface. Each shielding member 60 is in the form of a thin plate and entirely curved into an arcuate shape in conformity with the shape of the outer surface of the center core 58. The shielding members 60 may be, for example, embedded in the center core 58 as shown or may be bonded to the outer surface of the center core 58. The shielding members 60 can be bonded, for example, using a silicon adhesive.

The material of the shielding members 60 is preferably nonmagnetic and good in electrical conductivity. For example, oxygen-free copper or the like is used. The shielding members 60 shield by generating opposite magnetic fields by induction currents generated by the penetration of a magnetic field perpendicular to the surfaces of the shielding members 60 and canceling interlinkage fluxes (perpendicular penetrating magnetic field). Further, by using a good electrically conductive material, the generation of Joule heat by the induction currents is suppressed and the magnetic field can be efficiently shielded. In order to improve electrical conductivity, it is effective, for example, (1) to select a material with as small a specific resistance as possible and (2) to increase the thickness of the members. Specifically, it is preferable to select the thickness of the shielding members 60 in a range of 0.5 mm to 3 mm. In this way, the specific resistance of the shielding members 60 can be made sufficiently small and a sufficient magnetic shielding effect can be obtained, whereas the shielding members 60 can be made lighter. In this embodiment, the shielding members 60 having a thickness of 1 mm are used.

[Magnetic Shielding Portion]

If the shielding members 60 are located at positions (shielding positions: first posture) proximate to the outer surface of the heating belt 48 as shown in FIG. 2, magnetic resistance increases around the induction heating coil 52 to decrease magnetic field intensity. On the other hand, if the center core 58 is rotated by 180° (direction is not particularly limited) from the state shown in FIG. 2 and the shielding members 60 are moved to most distant positions (retracted positions, second posture) from the heating belt 48, magnetic resistance decreases around the induction heating coil 52 and magnetic paths are formed through the arch cores 54 and the side cores 56 at the opposite sides with the center core 58 as a center, whereby magnetic field act on the heating belt 48 and the heating roller 46.

Figure 3A:
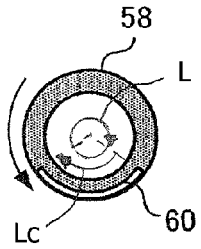
FIGS. 3A and 3B are diagrams showing an arrangement example of a shielding member.
Figure 3B:
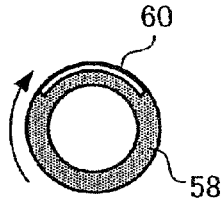
Figure 3B:
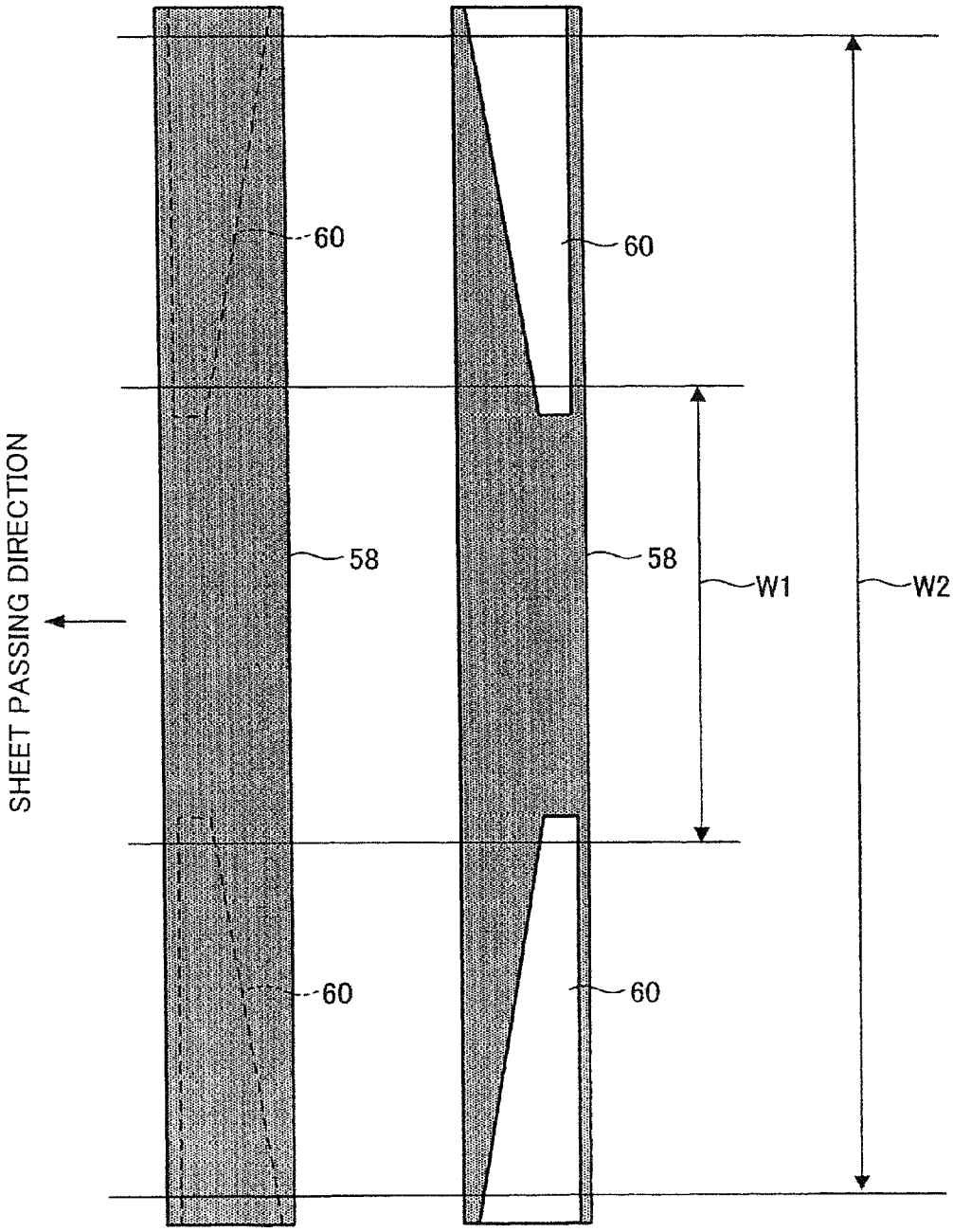

FIGS. 3A and 3B are diagrams showing an exemplary arrangement of the shielding members 60. A state shown in FIG. 3A corresponds to the above shielding position and a state show in FIG. 3B corresponds to the retracted position. Each of FIGS. 3A and 3B shows a side view of the center core 58 in an upper part and a plan view of the center core 58 in a lower part. In FIGS. 3A and 3B, the outer surface of the center core 58 is shown by halftone (painted out).

As described above, the entire length of the center core 58 is substantially equal to or longer than the maximum paper width W2 (first area) of sheets. At this time, two shielding members 60 are arranged while being spaced part in the longitudinal direction of the center core 58 and shaped symmetrical with each other. The respective shielding members 60 are trapezoidal in plan view as shown in FIG. 3B. The length of the shielding members 60 in a circumferential direction of the center core 58 is shortest at positions near the center of the center core 58 and gradually increased toward the opposite ends of the center core 58.

The shielding members 60 are arranged at the opposite outer sides of a minimum paper width W1 (second area; width of sheets of the minimum size out of those conveyed by the fixing unit 14) orthogonal to the sheet conveying direction, and only tiny parts of the shielding members 60 are provided in the range of the minimum paper width W1. The shielding members 60 reach positions slightly outside the maximum paper width W2 of sheets at the opposite ends of the center core 58. The minimum paper width W1 and the maximum paper width W2 are determined by sheets of the minimum size and the maximum size printable by the image forming apparatus 1.

As described above, in this embodiment, a ratio of the length of each shielding member 60 to the outer circumferential length of the center core 58 in the rotating direction of the center core 58 differs in a longitudinal direction (lengthwise direction) of the center core 58. At this time, if the ratio of the length (Lc) of each shielding member 60 to the outer circumferential length (L) of the center core 58 is a covering ratio (=Lc/L), the covering ratio is smaller at the inner side of the center core 58 and increases toward the outer sides (opposite ends) in the longitudinal direction. Specifically, the covering ratio is minimized in the vicinity of the maximum paper area (range of the minimum paper width W1) while being, conversely, maximized at the opposite ends of the center core 58.

The respective sheet sizes (paper widths) can be dealt with by switching the positions of the shielding members 60 to partially suppress the magnetic fluxes to be generated. At this time, excessive temperature increases can be prevented at the opposite ends of the heating roller 46 and the heating belt 48 by making an angle of rotation (rotational displacement amount) of the center core 58 differ according to the sheet size such that the larger the sheet size, the smaller the magnetic shielding amount and, conversely, the smaller the sheet size, the larger the magnetic shielding amount. Although clockwise and counterclockwise rotations are respectively shown by arrows in FIGS. 3A and 3B, the center core 58 may be rotated only in one direction. Further, the sheet passing direction may be opposite to the one shown in FIG. 3A.

[Rotating Mechanism]

Figure 4A:
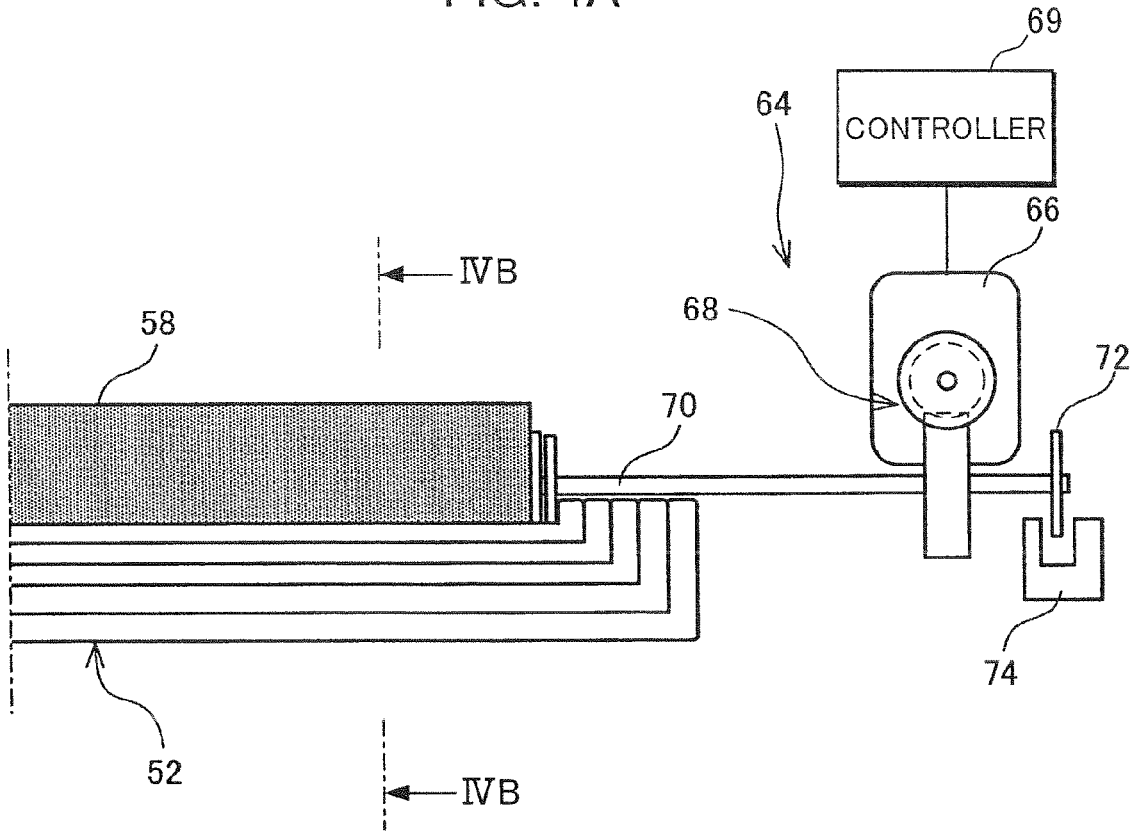
FIG. 4A is a side view showing the construction of a rotating mechanism and FIG. 4B is a section along IVB-IVB of FIG. 4A, FIGS. 5A and 5B are diagrams showing operation examples associated with the rotation of a center core (second core)
Figure 4B:
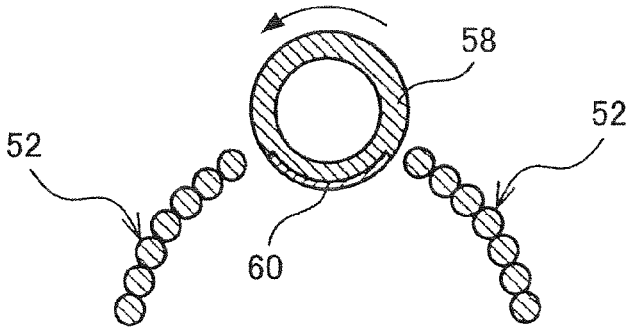

Next, a mechanism for rotating the center core 58 about its longitudinal axis is described. FIG. 4A is a side view showing the construction of a rotating mechanism 64 and FIG. 4B is a section along IVB-IVB. As shown in FIG. 4A, the rotating mechanism 64 includes a stepping motor 66, a speed reducing mechanism 68, a drive shaft 70 and a controller 69. The rotating mechanism 64 reduces the rotating speed of the stepping motor 66 to a specified rotating speed by means of the speed reducing mechanism 68 and drives the drive shaft 70 to rotate the center core 58 about its longitudinal axis. The longitudinal axis of the center core 58 extends in a direction intersecting with a direction in which a magnetic field generated by the induction heating coil 52 passes the center core 58.

A worm gear is, for example, used as the speed reducing mechanism 68, but something other than that may be used. A slitted disk 72 is provided at an end of the drive shaft 70 to detect the angle of rotation (rotational displacement amount from a reference position) of the center core 58, and a photo interrupter 74 is combined therewith.

The drive shaft 70 is connected with one end of the center core 58, and supports the center core 58 without penetrating inside the center core 58. The angle of rotation of the center core 58 is controlled by the number of drive pulses applied to the stepping motor 66. The controller 69 includes a control circuit for controlling the driving of the stepping motor 66. This control circuit can be, for example, constructed by a control IC, input and output drivers, a semiconductor memory and the like.

A detection signal from the photointerrupter 74 is inputted to the controller 69 via the input driver and the controller 69 detects the present angle of rotation (position) of the center core 58 in accordance with this detection signal. On the other hand, information on the present sheet size is notified to the controller 69 from an unillustrated image formation controller. In response to this information, the control IC reads information on an angle of rotation suitable for the sheet size from the semiconductor memory (ROM) and outputs drive pulses necessary to reach this target angle of rotation in a specified cycle. The drive pulses are applied to the stepping motor 66 via the output driver and the stepping motor 66 accordingly operates.

Figure 5B:
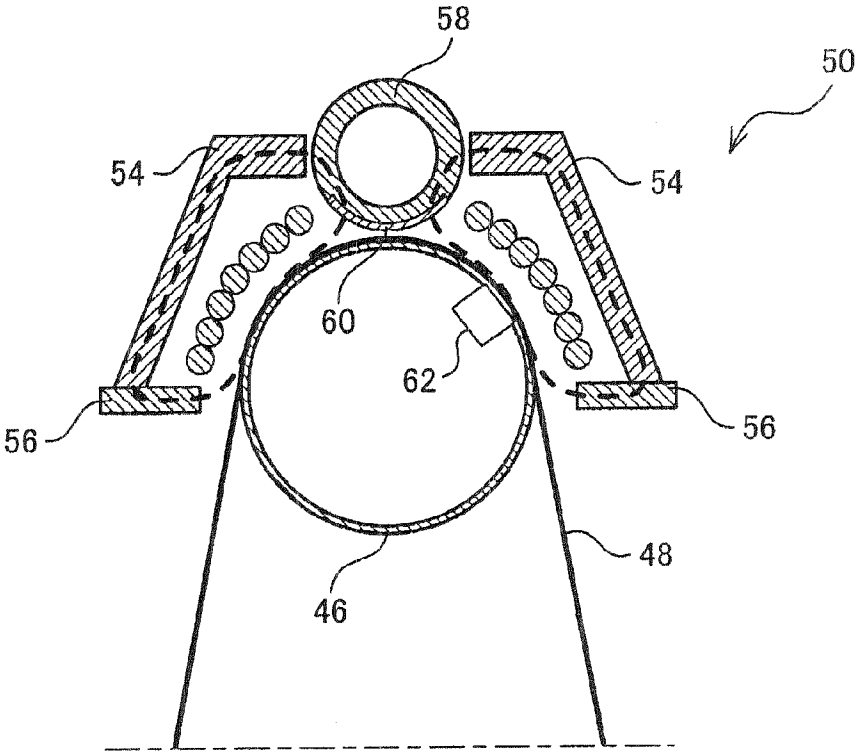
Figure 5A:
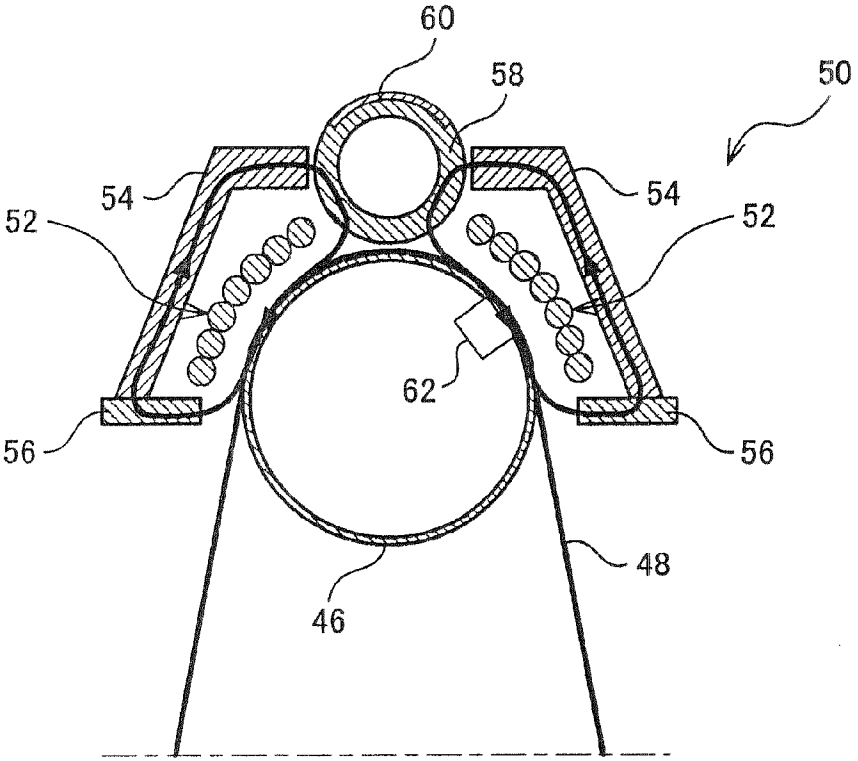

FIGS. 5A and 5B are diagrams showing operation examples associated with the rotation of the center core 58. FIG. 5A shows an operation example in the case of switching the shielding members 60 to the retracted positions (state where the second core is in the second posture) as the center core 58 is rotated. In this state, the shielding members 60 do not shield magnetism in the magnetic field generated by the induction heating coil 52. In this case, the magnetic field generated by the induction heating coil 52 passes the heating belt 48 and the heating roller 46 via the side cores 56, the arch cores 54 and the center core 58. At this time, eddy currents are generated in the heating belt 48 and the heating roller 46 as ferromagnetic bodies, and Joule heat is generated by the specific resistances of the respective materials to heat the heating belt 48 and the heating roller 46.

FIG. 5B shows an operation example in the case of switching the shielding members 60 to the shielding positions (state where the second core is in the first posture). In this state, the shielding members 60 shield magnetism in the magnetic field generated by the induction heating coil 52. In this case, since the shielding members 60 are located on the magnetic paths formed by the induction heating coil 52 outside the minimum paper area, the generation of the magnetic field is partially suppressed. In this way, the amount of heat generation outside the minimum paper area is suppressed and excessive temperature increases of the heating belt 48 and the heating roller 46 can be prevented.

Further, by changing the angle of rotation of the center core 58 little by little, the magnetic field shielding amount can be adjusted. For example, if the angle of rotation of the center core 58 is increased in the counterclockwise direction from the position of FIG. 5B, no shielding is performed at the left side of FIG. 5B and the magnetic field is generated, but the magnetic field continues to be shielded at the right side of FIG. 5B. In this case, the intensity of the generated magnetic field is reduced as a whole as compared to the one at the position of FIG. 5A, wherefore the amount of heat generation can be reduced by that much.

[Structural Parameters]

Figure 6:
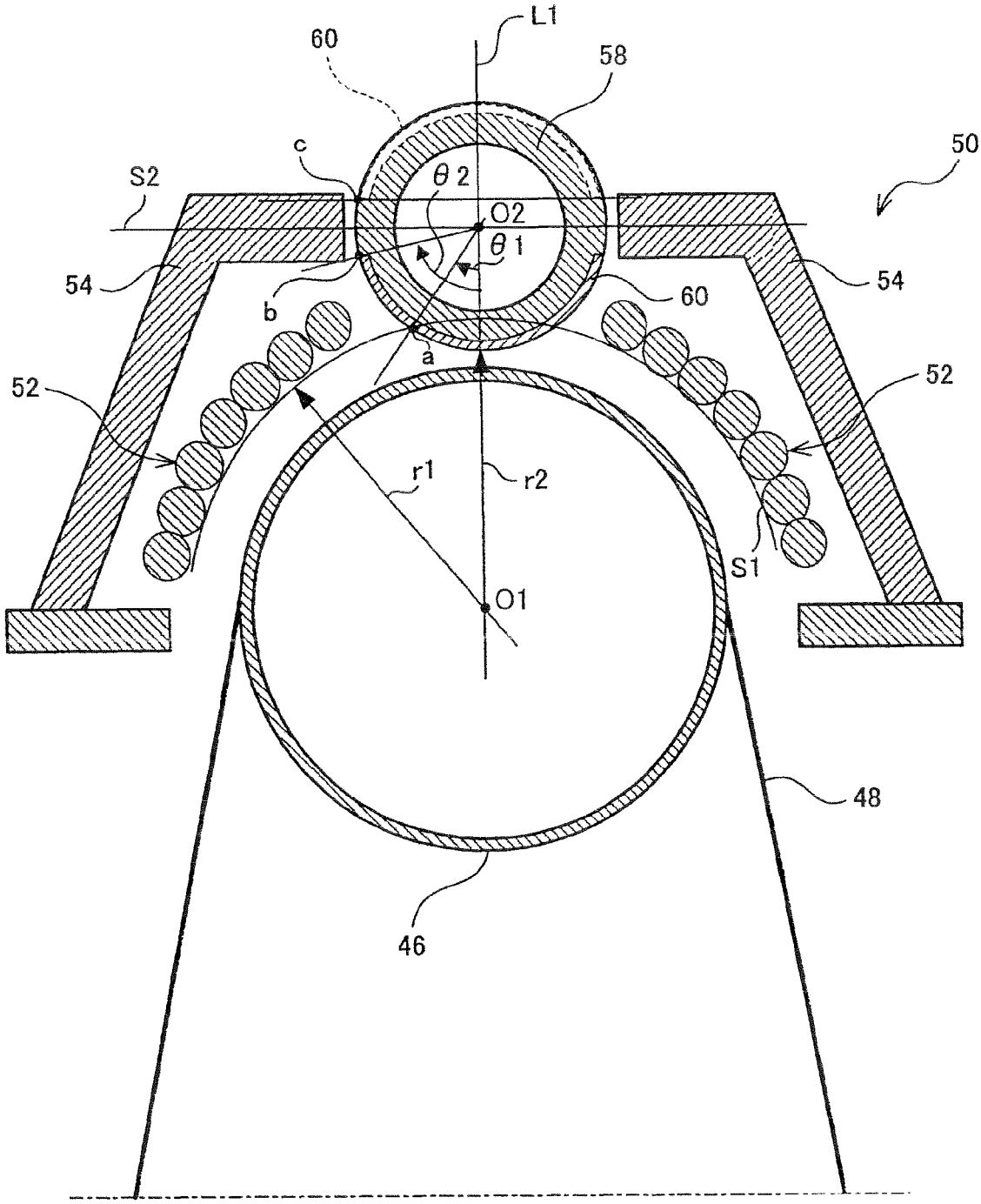
FIG. 6 is a diagram showing structural parameters set in the first embodiment.

In order to satisfactorily obtain the magnetic field adjustment effect as described above, the following optimal parameters are set for the structure of the IH coil unit 50. FIG. 6 is a diagram showing structural parameters set in this embodiment. A mutual relationship of the parameters is described below.

In light of the structure of the IH coil unit 50, the heating belt 48 has the arcuate outer surface at a position where it is in contact with the heating roller 46. The induction heating coil 52 is arranged on a virtual concentric arcuate surface (S1 in FIG. 6) extending along and outside this arcuate outer surface. The center core 58 has a tubular shape centered on its longitudinal axis, and the shielding members 60 bonded to (or embedded in) the outer surface of the center core 58 have arcuately curved shapes. At this time, the following relationships hold.

[Relationship of $r1 \geqq r2$]

A parameter r1 corresponds to a radius of curvature of the virtual arcuate surface (S1) on which the induction heating coil 52 is arranged. A parameter r2 corresponds to a shortest distance from a center of curvature O1 of the arcuate outer surface of the heating belt 48 to the outer surfaces of the shielding members 60 with the shielding members 60 switched to the shielding positions. At this time, the magnetic field can be reliably shielded at the shielding positions by satisfying the relationship of $r1 \geqq r2$.

[Relationship of $\theta 2 \geqq \theta 1$]

Parameters $\theta 1$, $\theta 2$ are both angles centered on the longitudinal axis of the center core 58. The parameter $\theta 1$ corresponds to an angle between a virtual straight line (L1 in FIG. 6) connecting the center of curvature O1 of the arcuate outer surface of the heating belt 48 and a center O2 of the center core 58 and a straight line connecting the center O2 of the center core 58 and an intersection ("a" in FIG. 6) of the outer surface of the center core 58 and the virtual arcuate surface (S1) on which the induction heating coil 52 is arranged. The parameter $\theta 2$ corresponds to an angle between the above virtual straight line (L1) and a straight line connecting the center O2 of the center core 58 and an end point ("b" in FIG. 6) of the shielding member 60 with the shielding member 60 switched to the shielding position. At this time, if the relationship of $\theta 2 \geqq \theta 1$ is satisfied, the magnetic path can be reliably cut off in a central side of the induction heating coil 52, wherefore the magnetic shielding effect by the shielding members 60 can be sufficiently exhibited.

[Positional Relationship Between Plane S2 and End Point "c"]

A virtual plane (S2 in FIG. 6) shown in FIG. 6 is a plane orthogonal to the above virtual straight line (L1) at the center O2 of the center core 58. Horizontal parts of the arch cores 54 in FIG. 6 are formed with this virtual plane (S2) as centers. At this time, the positions of the end points ("c" in FIG. 6) of the shielding members 60 are set to be more distant from the arcuate outer surface of the heating belt 48 than the virtual plane (S2) with the shielding members 60 switched to the retracted positions (positions shown by broken line in FIG. 6). In other words, if the shielding members 60 have an arcuate shape and this arcuate shape is excessively long in the circumferential direction, there is a possibility of cutting off the magnetic path at the positions of the end points even if the shielding members 60 are moved to the retracted positions. Accordingly, in this embodiment, such a structure as not to shield the magnetism at the retracted positions is adopted by locating the positions of the end points (c) more distant from the heating belt 48 than the centers of the horizontal parts of the arch cores 54 with the shielding members 60 moved to the retracted positions. Thus, there is no likelihood of hindering the induction heating efficiency of the heating belt 48 at the retracted positions.

[First Modification]

Figure 7:
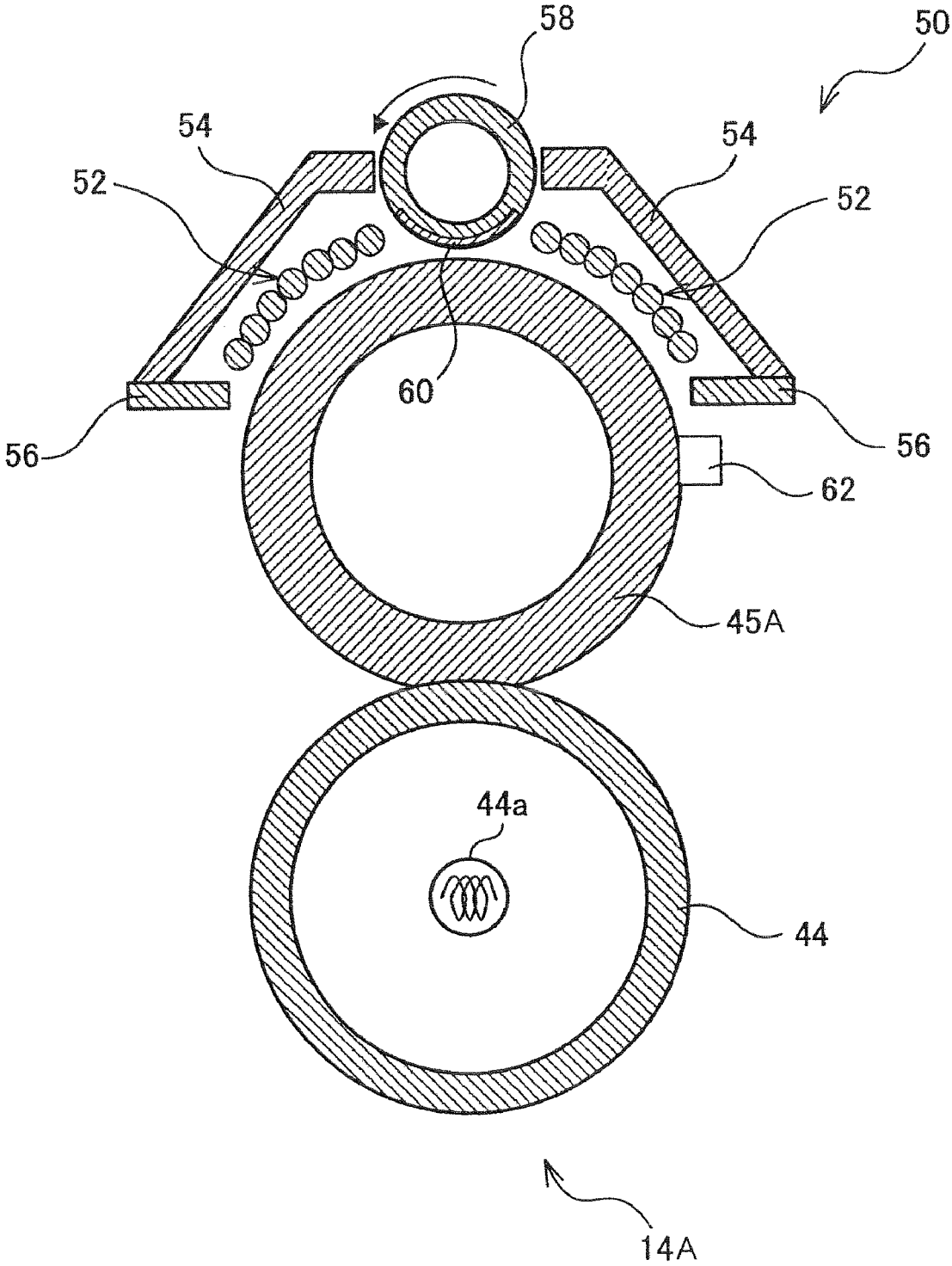
FIG. 7 is a diagram showing a first modification of the first embodiment.

FIG. 7 is a diagram showing a fixing unit 14A according to a first modification of the fixing unit 14 of the first embodiment. In this fixing unit 14A, a toner image is fixed by a fixing roller 45A and the pressure roller 44 without using the above heating belt 48. The IH coil unit 50 is arranged to face the circumferential surface of this fixing roller 45A.

A magnetic body similar to that of the above heating belt is, for example, wound around the outer circumferential surface of the fixing roller 45A, and the magnetic body is induction-heated by the induction heating coil 52. In this case, the thermistor 62 is disposed at a position outside the fixing roller 45A to face a magnetic body layer. The other construction is similar to the above and the magnetic field shielding amount can be adjusted by rotating the center core 58.

[Second Modification]

Figure 8:
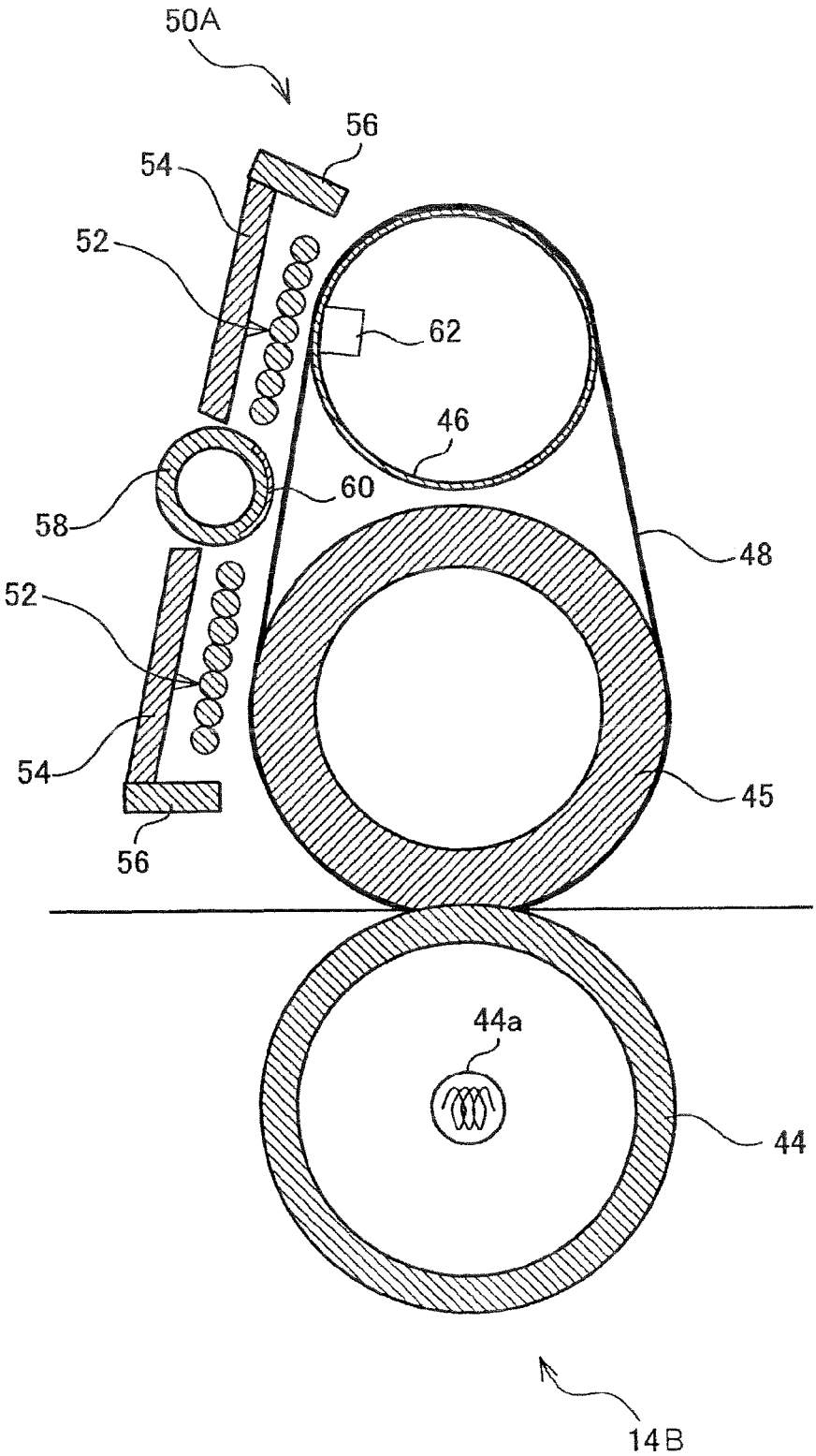
FIG. 8 is a diagram showing a second modification of the first embodiment.

FIG. 8 is a diagram showing a fixing unit 14B according to a second modification of the fixing unit 14 of the first embodiment. In this example, an IH coil unit 50A having a different mode is used. In this construction example, the IH coil unit 50A performs induction heating not at a position facing the arcuate part of the heating belt 48, but at a position facing a flat part of the heating belt 48 between the heat roller 46 and the fixing roller 45. In this case as well, the magnetic field shielding amount can be similarly adjusted by rotating the center core 58.

<Second Embodiment of the Fixing Unit>

Figure 9:
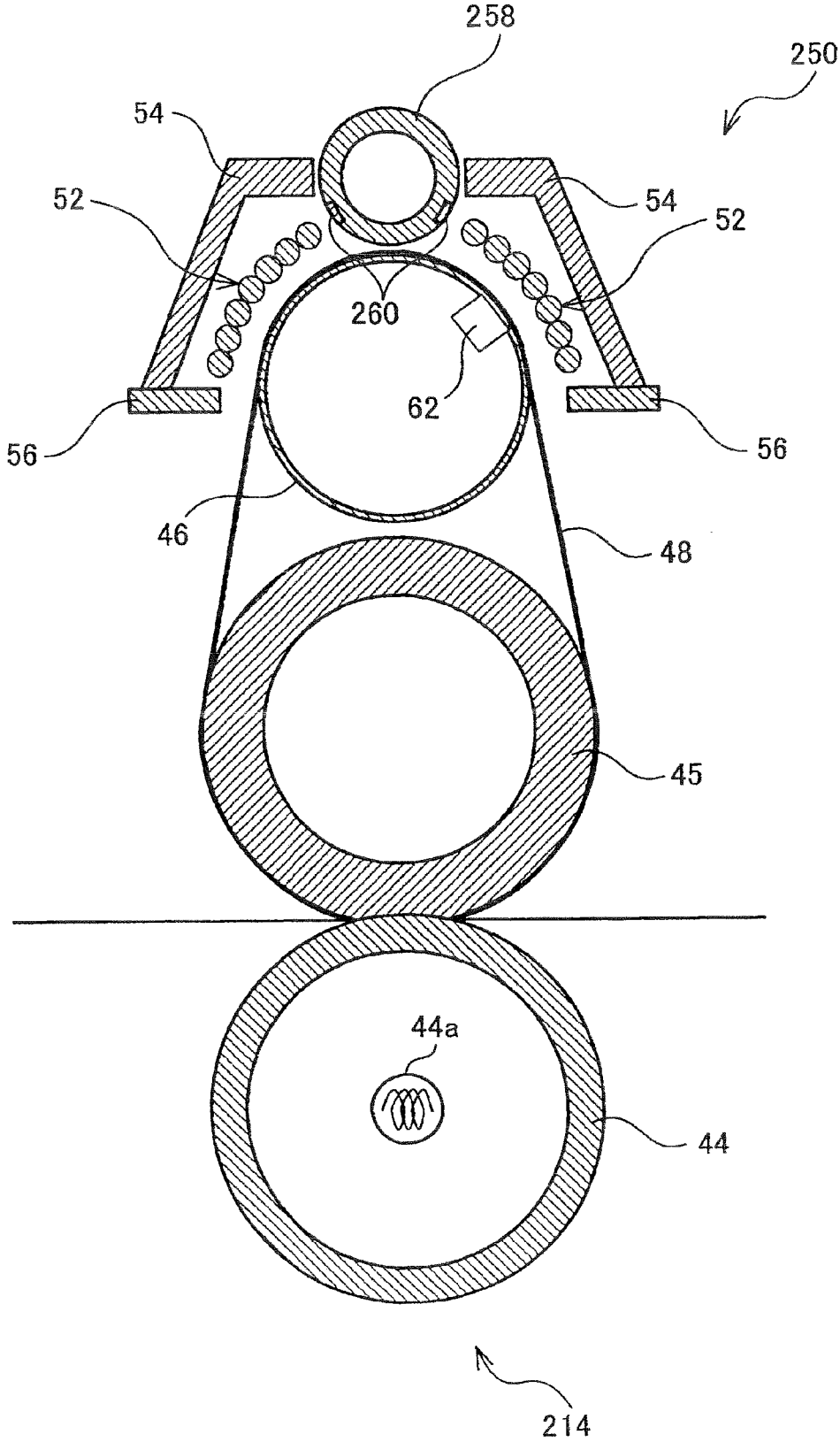
FIG. 9 is a vertical section showing the structure of a fixing unit according to a second embodiment of the invention.

FIG. 9 is a vertical section showing the structure of a fixing unit 214 according to a second embodiment. The fixing unit 214 includes a pressure roller 44, a fixing roller 45, a heat roller 46 and a heating belt 48 as in the above fixing unit 14. Since these members are similar to those of the first embodiment, they are not described here.

The fixing unit 214 further includes an IH coil unit 250 at an outer side of the heat roller 46 and the heating belt 48. The IH coil unit 250 includes an induction heating coil 52 (coil), a pair of arch cores 54 (part of a first core), a pair of side cores 56 (part of the first core) and a center core 258 (second core). Shielding members 260 are mounted along the outer surface of the center core 258. Since the fixing unit 214 of the second embodiment substantially differs from the fixing unit 14 of the first embodiment only in the shielding members 260 provided in this center core 258, the following description is centered on these and the other parts are described either not all or only briefly.

The shielding members 260 of the second embodiment have a closed frame portion. When the shielding members 260 on the center core 258 are at shielding positions (first posture), a magnetic field generated by the induction heating coil 52 penetrates through the closed frames of the shielding members 260. On the other hand, when the shielding members 260 on the center core 258 are at retracted positions (second posture), the magnetic field generated by the induction heating coil 52 passes outside the closed frames of the shielding members 260.

The center core 258 is a core made of ferrite and having a tubular shape. Although not shown in FIG. 9, the center core 258 is connected with a rotating mechanism (see FIG. 13A) and made rotatable about its longitudinal axis by this rotating mechanism.

The shielding members 260 are mounted along the outer surface of the center core 258. Each shielding member 260 is one rectangular frame shape (ring shape) formed by punching out an inner part of a thin plate while leaving only a peripheral edge portion thereof, and is arcuately curved as a whole. The shielding members 260 may be, for example, embedded in thick parts of the center core 258 as shown or may be bonded to the outer surface of the center core 258. The shielding members 260 can be bonded, for example, using a silicon adhesive.

The material of the shielding members 260 is preferably nonmagnetic and good in electrical conductivity. For example, oxygen-free copper or the like is used. The shielding members 260 shield magnetism by generating opposite magnetic fields from induction currents generated by the penetration of perpendicular magnetic field in the closed frames of the shielding members 260 and canceling interlinkage fluxes (perpendicular penetrating magnetic field). Further, by using a good electrically conductive material, the generation of Joule heat by the induction currents is suppressed and the magnetic field can be efficiently shielded. In order to improve electrical conductivity, it is effective, for example, (1) to select a material with as small a specific resistance as possible and (2) to increase the thickness of the members. Specifically, it is preferable to select the thickness of the shielding members 260 in a range of 0.5 mm to 3 mm. In this embodiment, the shielding members 260 having a thickness of 1 mm are used.

As shown in FIG. 9, if the shielding members 260 are at positions (shielding positions; first posture) proximate to the outer surface of the heating belt 48, magnetic resistance increases around the induction heating coil 52 to reduce magnetic field intensity. On the other hand, if the center core 258 is rotated by 180° (direction is not particularly limited) from the state shown in FIG. 9 and the shielding members 260 are moved to most distant positions (retracted positions, second posture) from the heating belt 48, magnetic resistance decreases around the induction heating coil 52 and magnetic paths are formed through the arch cores 54 and the side cores 56 at the opposite sides with the center core 58 as a center, whereby a magnetic field acts on the heating belt 48 and the heating roller 46.

[Structure Example (1) of the Shielding Member]

Figure 10:
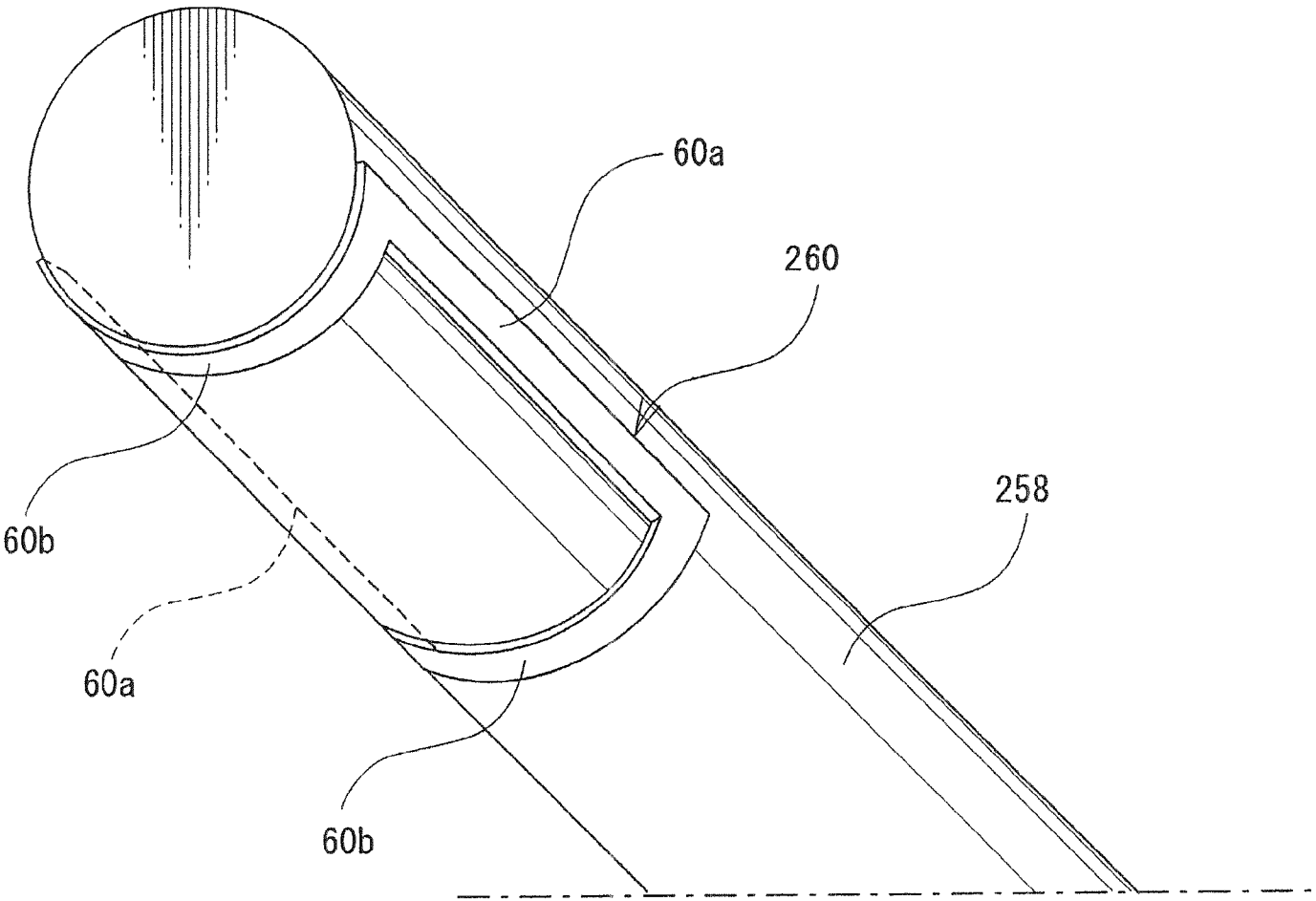
FIG. 10 is a perspective view showing a structure example (1) of a shielding member.

FIG. 10 is a perspective view showing the shielding member 260 according to a structure Example (1). The shielding member 260 has a rectangular frame shape as a whole, and four sides thereof include a pair of straight portions 60*a* facing in a width direction and a pair of arcuate portions 60*b* facing in a longitudinal direction. In this example, the shielding member 260 is arranged at one end (outside the minimum paper area) of the center core 258. The shielding member 260 is similarly arranged at the other end of the center core 258.

Figure 11A:
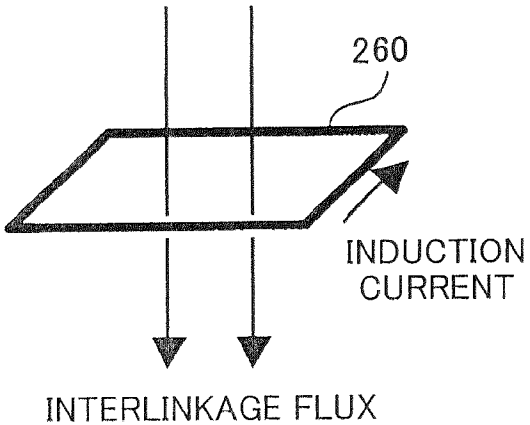
FIGS. 11A to 11C are conceptual diagrams showing the principle of a magnetic shielding effect by the shielding member.
Figure 11B:
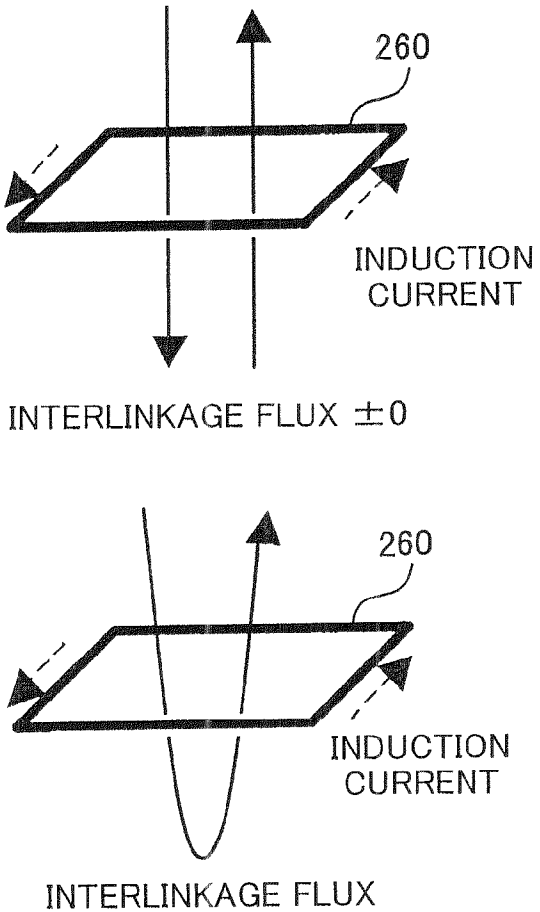
Figure 11C:
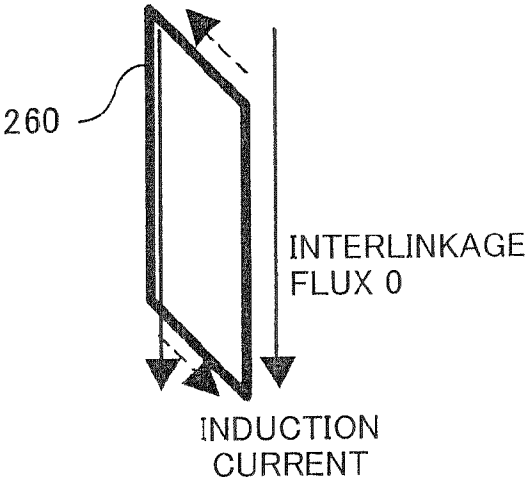

FIGS. 11A to 11C are conceptual diagrams showing the principle of a magnetic field shielding effect by the shielding member 260. In FIGS. 11A to 11C, the shielding member 260 is simply shown as a mere wire model.

As shown in FIG. 11A, upon the generation of a magnetic field (interlinkage flux) penetrating a closed frame surface (virtual plane) of the shielding member 260 having the closed frame shape in a perpendicular direction (one direction), an induction current is accordingly generated in a circumferential direction of the shielding member 260. Then, a magnetic field (opposite magnetic field) acting in a direction opposite to the penetrating magnetic field is generated by electromagnetic induction, wherefore these magnetic fields cancel each other to eliminate the magnetic fields. In the second embodiment, magnetism is shielded using this magnetic field canceling effect.

A case is assumed where penetrating magnetic fields are generated in both directions through the closed frame surface of the shielding member 260 as shown in an upper part of FIG. 11B and the sum total of the interlinkage fluxes at this time are substantially 0 (±0). In this case, substantially no induction current is generated in the shielding member 260. Accordingly, the shielding member 260 hardly exhibits its magnetic field canceling effect and the magnetic fields just pass the shielding member 260 in both directions. This similarly holds also in the case where a magnetic field passes the inner side of the shielding member 260 in a U-turn direction as shown in a lower part of FIG. 11B. In the second embodiment, the magnetic field is caused to pass by retracting the shielding members 260 to positions where no magnetic field penetrates therethrough in any direction.

FIG. 11C shows a case where a magnetic field (interlinkage flux) is generated substantially in parallel with the closed frame surface of the shielding member 260. In this case as well, substantially no induction current is similarly generated in the shielding member 260, wherefore there is no magnetic field canceling effect. This is a retraction technique mainly used in prior arts although not employed in this embodiment. However, the shielding member 260 needs to be largely displaced to obtain such a magnetic field environment around the induction heating coil 52 and, accordingly, a movable space becomes larger.

Attention is focused on the point that the magnetic shielding effect can be obtained by the principle shown in FIG. 11A, and optimal magnetic shielding is performed by displacing the shielding members 260 between the shielding positions and the retracted positions as the center core 258 is rotated.

[Structure Example (2) of the Shielding Member]

Figures 12A, 12B:
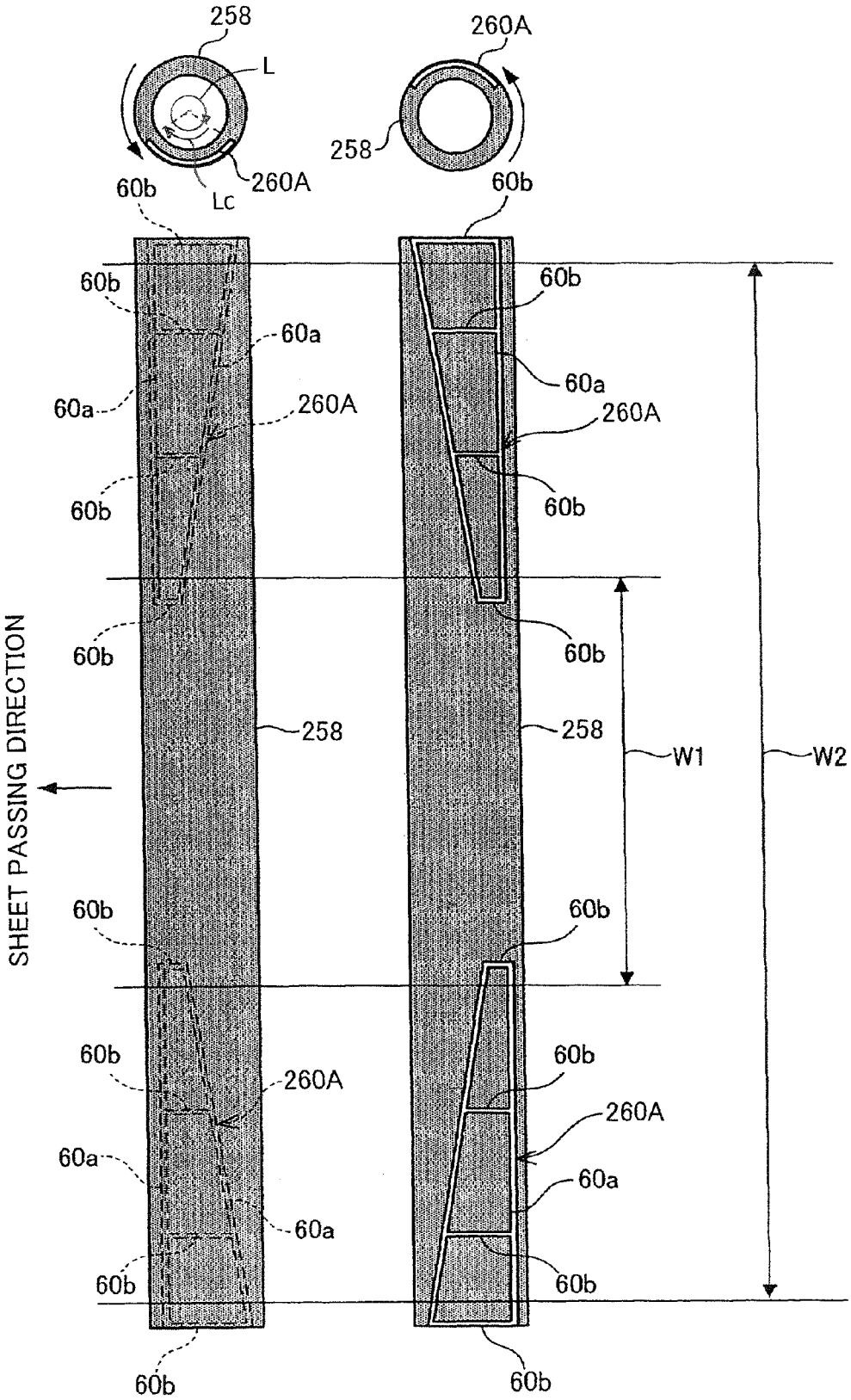
FIGS. 12A and 12B are diagrams showing a structure example (2) of the shielding member.

FIGS. 12A and 12B are diagrams showing shielding members 260A according to a structure example (2). FIG. 12A corresponds to the above shielding positions and FIG. 12B corresponds to the above retracted positions. Each of FIGS. 12A and 12B shows a side view of the center core 258 in an upper part and a plan view thereof in a lower part. In FIGS. 12A and 12B, exposed parts of the outer surface of the center core 258 are shown by halftone.

The entire length of the center core 258 is substantially equal to or longer than the maximum paper width W2 of sheets. At this time, two shielding members 260A are arranged while being spaced part in the longitudinal direction of the center core 258 and shaped symmetrical with each other. The entire outer shapes of the respective shielding members 260A are trapezoidal in plan view as shown in FIG. 12B. The length (frame width) of the shielding members 260A in the circumferential direction of the center core 258 is shortest at positions near the center of the center core 258 and gradually increased toward the opposite ends of the center core 258.

Particularly, each shielding member 260A is one rectangular frame as a whole, and an inner part thereof is divided into a plurality of closed frame portions by a plurality of arcuate portions 60*b*. In the case of such a construction, a shielding effect can be exhibited using the individual divided closed-frames, wherefore sheets of various sizes can be dealt with.

The shielding members 260A are provided at the opposite sides of the minimum paper width W1 orthogonal to the sheet passing direction, and only tiny parts of the shielding members 260A are present in the range of the minimum paper width W1. On the other hand, the shielding members 260A project slightly outward from the maximum paper width W2 of sheets at the opposite ends of the center core 258. The minimum paper width W1 and the maximum paper width W2 are determined by sheets of the minimum size and the maximum size printable by the image forming apparatus 1.

In the structure example (2), a ratio of the length (frame width) of each shielding member 260A to the outer circumferential length of the center core 258 in the rotating direction of the center core 258 differs in the longitudinal direction (lengthwise direction) of the center core 258. At this time, if the ratio of the frame width (Lc) of each shielding member 260A to the outer circumferential length (L) of the center core 258 is a covering ratio (=Lc/L), the covering ratio is smaller at the inner side of the center core 258 and increases toward the outer sides (opposite ends) in the longitudinal direction. Specifically, the covering ratio is minimized in the vicinity of the minimum paper area (range of the minimum paper width W1) while being, conversely, maximized at the opposite ends of the center core 258.

The respective sheet sizes (paper widths) can be dealt with by moving the shielding members 260A to partially suppress the magnetic flux to be generated as the center core 258 is rotated. At this time, excessive temperature increases can be prevented at the opposite ends of the heating roller 46 and the heating belt 48 by making an angle of rotation (rotational displacement amount) of the center core 258 differ according to the sheet size such that the larger the sheet size, the smaller the magnetic shielding amount and, conversely, the smaller the sheet size, the larger the magnetic shielding amount. Although a counterclockwise rotation is respectively shown by arrows in FIGS. 12A and 12B, the center core 258 may be rotated in a clockwise direction. Further, the sheet passing direction may be opposite to the one shown in FIG. 12A.

Figure 13A:
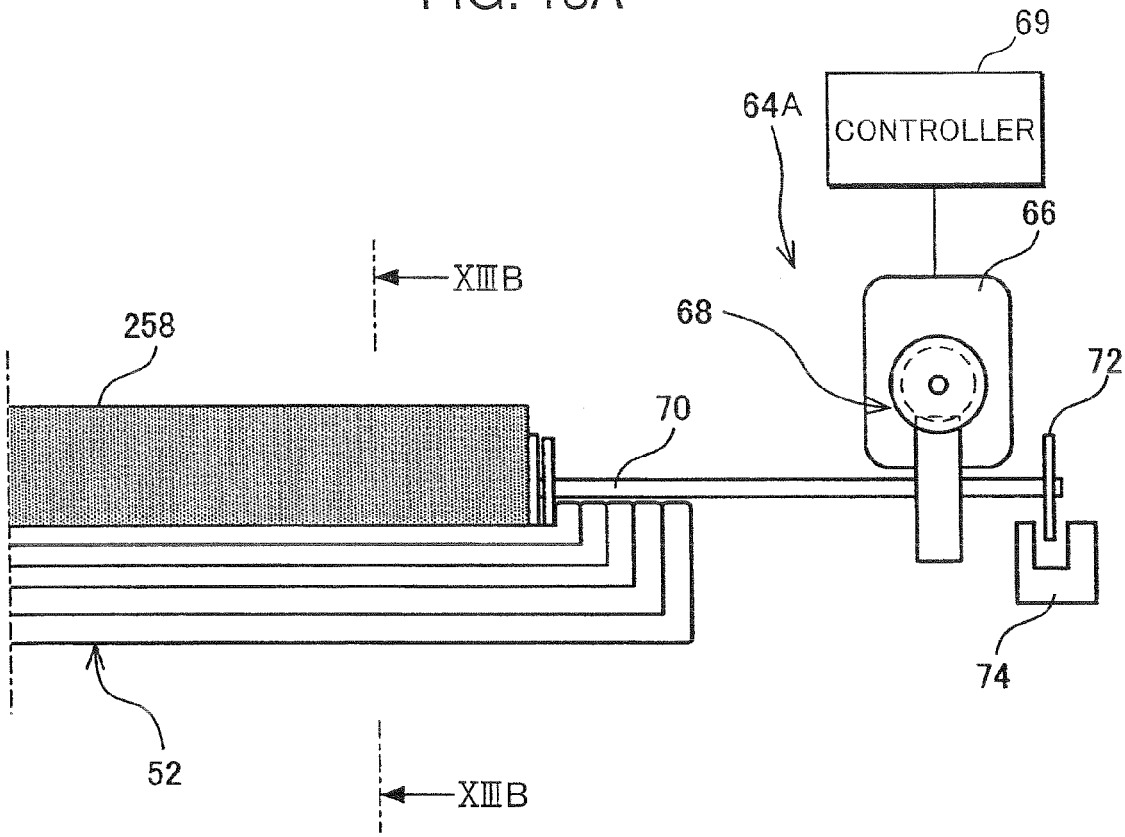
FIG. 13A is a side view showing the construction of a rotating mechanism and FIG. 13B is a section along XIIIB-XIIIB of FIG. 13A, FIGS. 14A and 14B are diagrams showing operation examples in the case of using the shielding member of the structure example (2)
Figure 13B:
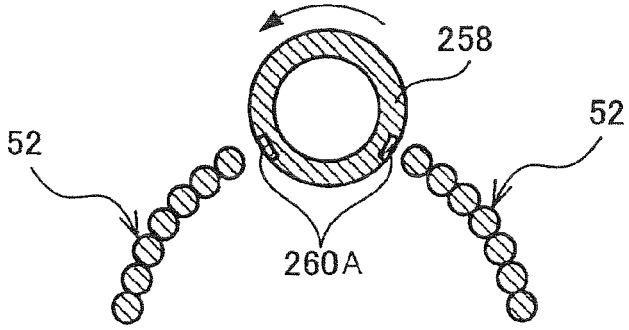

A mechanism for rotating the center core 258 about its longitudinal axis is similar to that of the first embodiment. FIG. 13A is a side view showing the construction of a rotating mechanism 64A for rotating the center core 258 and FIG. 13B is a section along XIIIB-XIIIB of FIG. 13A. The rotating mechanism 64A includes a stepping motor 66, a speed reducing mechanism 68, a drive shaft 70 and a controller 69. Since these constituent parts are the same as in the first embodiment, they are not described here.

[Operations of the Structure Examples (1) and (2)]

Figure 14B:
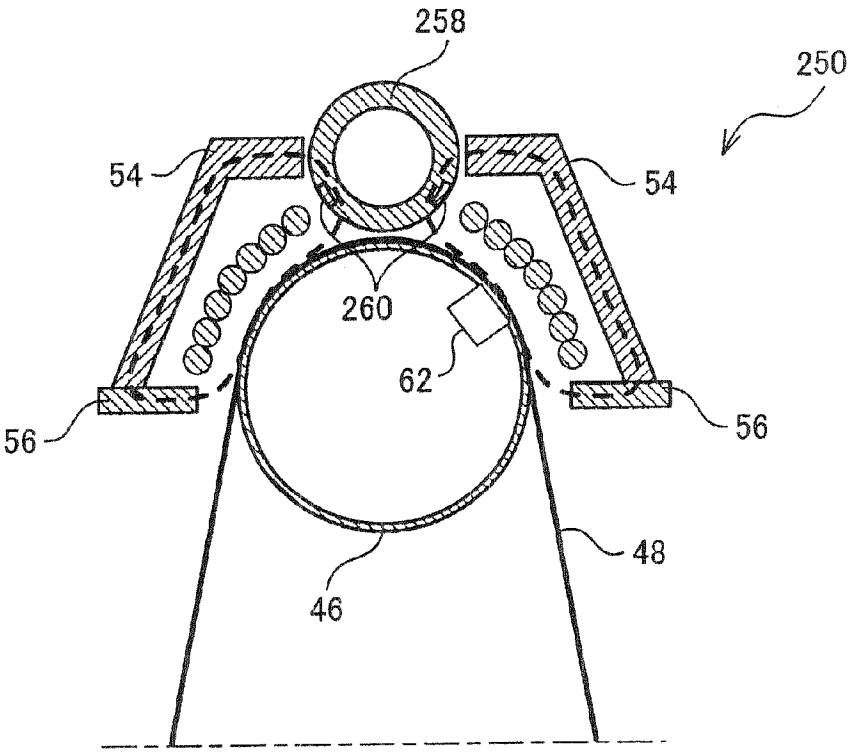
Figure 14A:
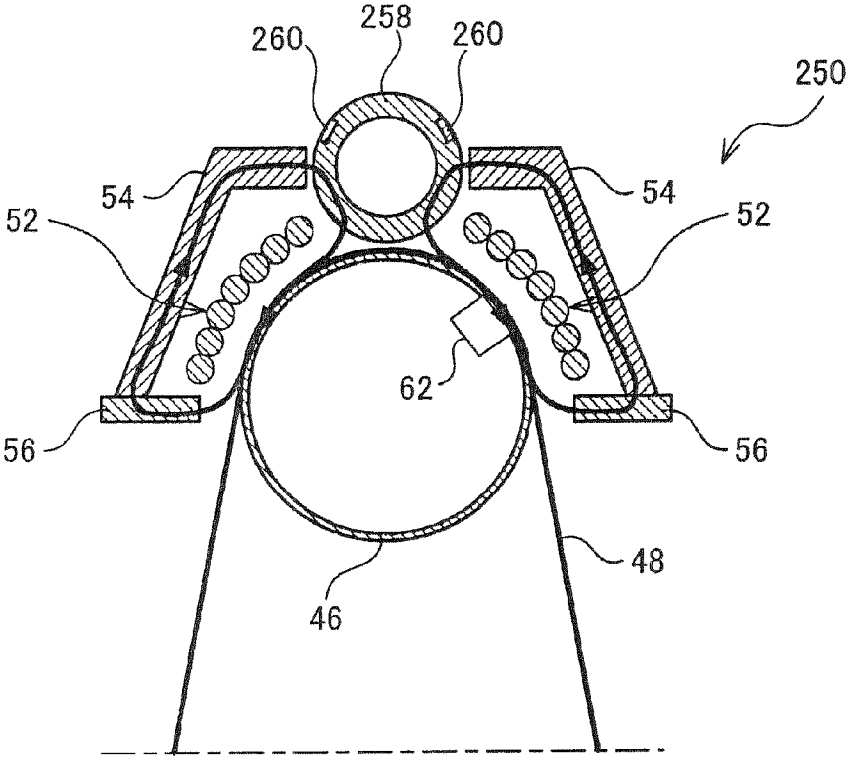

FIGS. 14A and 14B are diagrams showing operation examples of the shielding members 260 (260A) as the center core 258 is rotated. The respective operation examples are described below.

FIG. 14A shows the operation example in the case of switching the shielding members 260 to the retracted positions (state where the second core is in the second posture). In this state, the shielding members 260 do not shield magnetism in the magnetic field generated by the induction heating coil 52. Specifically, in this case, the magnetic field generated by the induction heating coil 52 passes outside the closed frames of the shielding members 260 instead of penetrating through the closed frames. Accordingly, the magnetic field passes the heating belt 48 and the heating roller 46 via the side cores 56, the arch cores 54 and the center core 258. At this time, eddy currents are generated in the heating belt 48 and the heating roller 46 as ferromagnetic bodies, and Joule heat is generated by the specific resistances of the respective materials to heat the heating belt 48 and the heating roller 46.

FIG. 14B shows the operation example in the case of switching the shielding members 260 to the shielding positions (state where the second core is in the first posture). In this state, the shielding members 260 shield magnetism in the magnetic field generated by the induction heating coil 52. In other words, in this case, the shielding members 260 are located on the magnetic paths outside the minimum paper area and the magnetic field penetrates through the closed frames of the shielding members 260. Thus, the generation of the magnetic field is partially suppressed by the principle shown in FIG. 11A. Therefore, the amount of heat generation is suppressed outside the minimum paper area and excessive temperature increases of the heating belt 48 and the heating roller 46 can be prevented.

In the case of the structure example (2), the magnetic field shielding amount can be adjusted by changing the angle of rotation of the center core 258 little by little. For example, if the angle of rotation of the center core 258 is increased in the counterclockwise direction from the position of FIG. 14B, no shielding is performed in parts of the outer surface of the center core 258 (near the minimum paper area) where the closed frames of the shielding members 260 are displaced from the shielding positions and the magnetic field is generated. However, the magnetic field continues to be shielded in other parts (outside the minimum paper area).

[Structure Example (3) of the Shielding Member]

Figure 15:
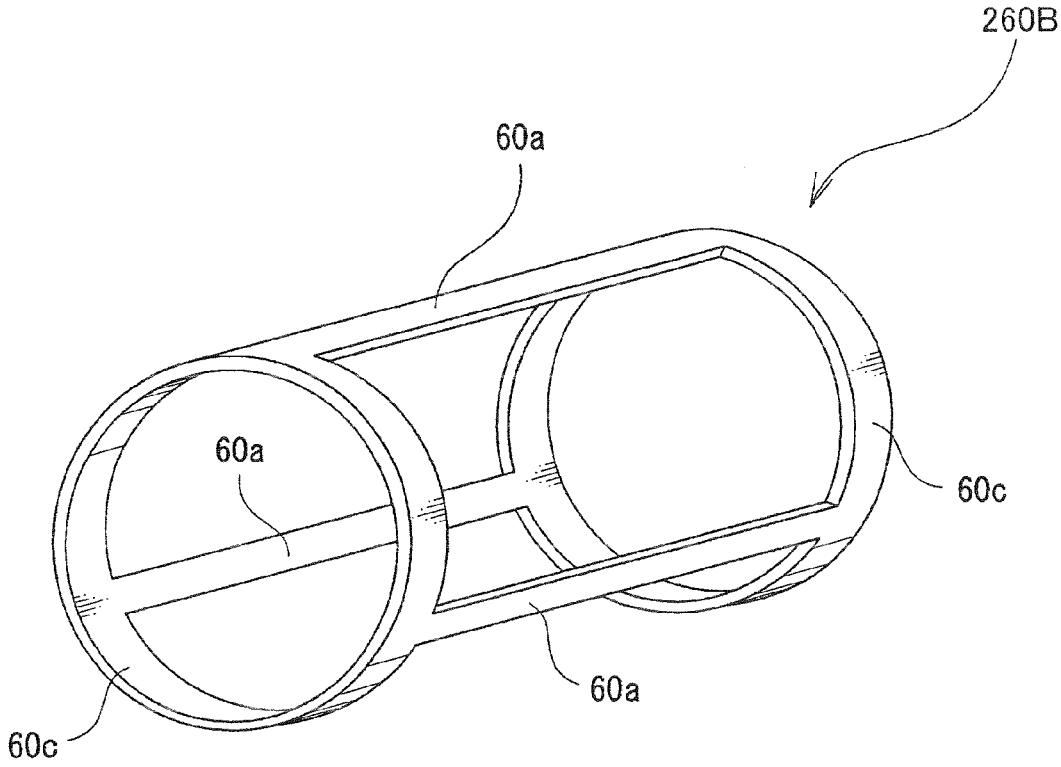
FIG. 15 is a perspective view showing a structure example (3) of the shielding member.

FIG. 15 is a perspective view showing a shielding member 260B according to a structure example (3). Here, the center core 258 is not shown. The shielding member 260B has a tubular shape as a whole. In other words, the shielding member 260B is constructed such that a pair of ring portions 60*c* at the opposite longitudinal end positions are connected by three straight portions 60*a*. The straight portions 60*a* are spaced apart in a circumferential direction of the ring portions 60*c*. In the structure example (3) as well, two shielding members 260B are arranged at one end (outside the minimum paper area) and the other end of the center core 258.

In such a shielding member 260B, closed frames are formed at three positions in the circumferential direction. In other words, one closed frame is formed by two straight portions 60*a* adjacent in the circumferential direction and the ring portions 60*c* connected by these. Therefore, the shielding member 260B includes three closed frames as a whole.

[Operation of the Structure Example (3)]

Figure 16B:
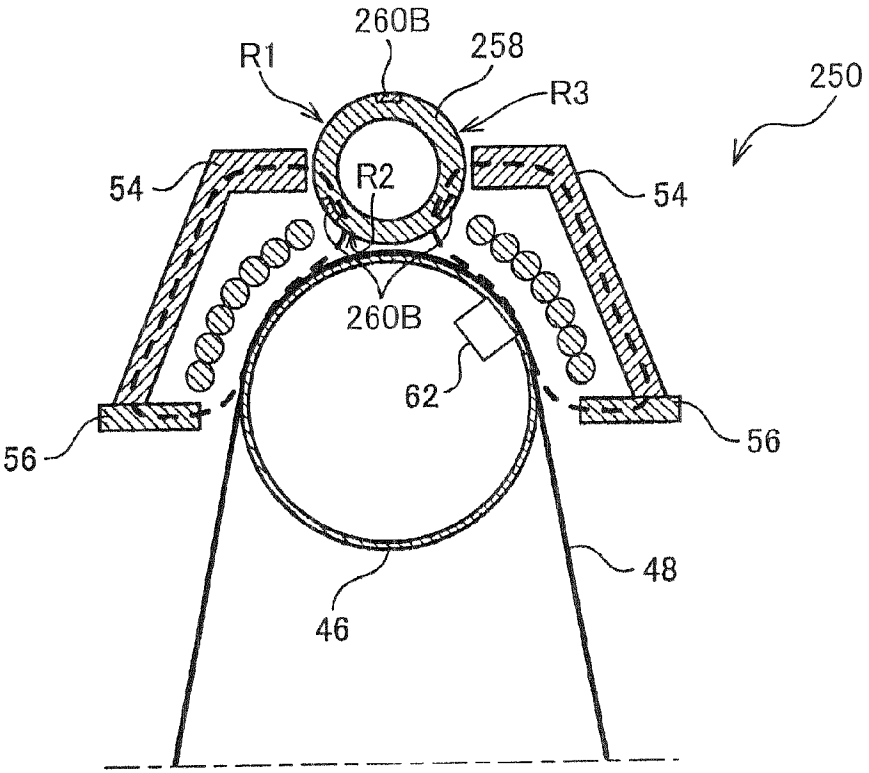
FIGS. 16A and 16B are diagrams showing operation examples in the case of using the shielding member of the structure example (3)
Figure 16A:
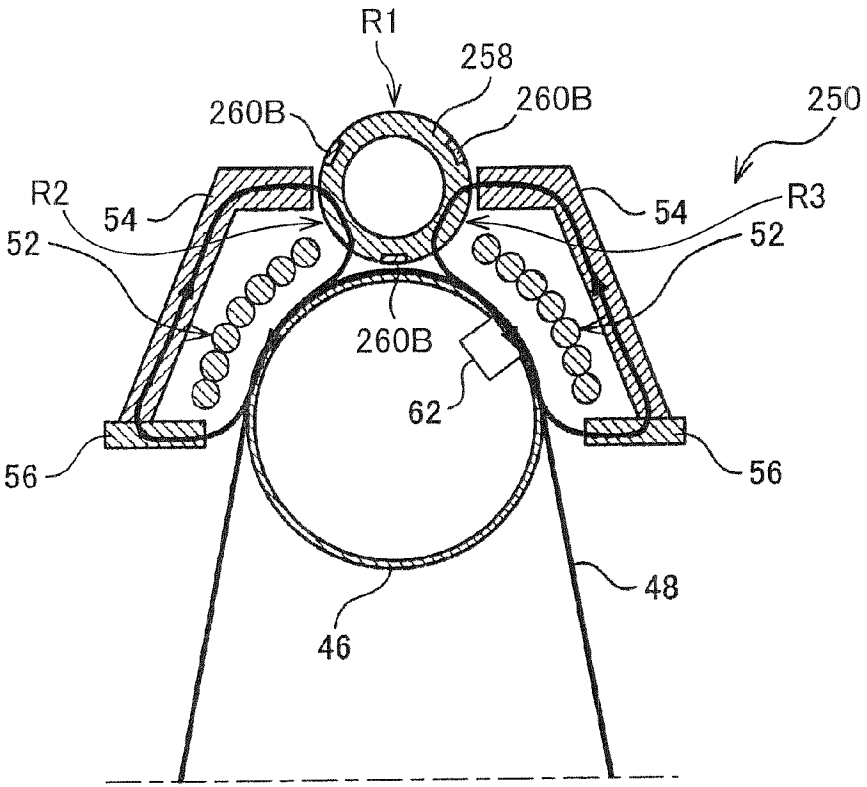

FIGS. 16A and 16B are operation examples in the case of using the shielding members 260B of the structure example (3).

FIG. 16A shows the operation example in the case of switching the shielding members 260B to the retracted positions as the center core 258 is rotated. In this state, the shielding members 260B do not shield magnetism in the magnetic field generated by the induction heating coil 52. In the case of the structure example (3), the principle shown in the lower part of FIG. 11B is applied with the shielding members 260B retracted.

Specifically, one closed frame R1 located at a side (upper side in FIG. 16A) opposite to the heating roller 46 is retracted to the outside of the magnetic field by locating one of the three straight portions 60*a* on the center line of the coil 52. The other two closed frames R2, R3 permit the magnetic field to pass in U-turn directions. By arranging such closed frames R1, R2 and R3, a state where the magnetic shielding effect is not exhibited is realized. Accordingly, the magnetic field generated by the induction heating coil 52 passes the heating belt 48 and the heating roller 46 via the side cores 56, the arch cores 54 and the center core 258. At this time, eddy currents are generated in the heating belt 48 and the heating roller 46 as ferromagnetic bodies, and Joule heat is generated by the specific resistances of the respective materials to heat the heating belt 48 and the heating roller 46.

FIG. 16B shows the operation example in the case of switching the shielding members 260B to the shielding positions. In this state, the shielding members 260B shield magnetism in the magnetic field generated by the induction heating coil 52. In this case, the closed frames R1, R2 and R3 of the shielding members 260B are respectively located on magnetic paths outside the minimum paper area and the magnetic field penetrates through these closed frames. In other words, the magnetic path passing the left arch core 54 in FIG. 16B penetrates through the closed frame R1 and additionally penetrates through the closed frame R2. The magnetic path passing the right arch core 54 in FIG. 16B penetrates through the closed frame R3 and additionally penetrates through the closed frame R2. Thus, the generation of the magnetic field is partially suppressed by the principle shown in FIG. 11A. Therefore, the amount of heat generation is suppressed outside the minimum paper area and excessive temperature increases of the heating belt 48 and the heating roller 46 can be prevented.

[Structural Parameters]

Figure 17:
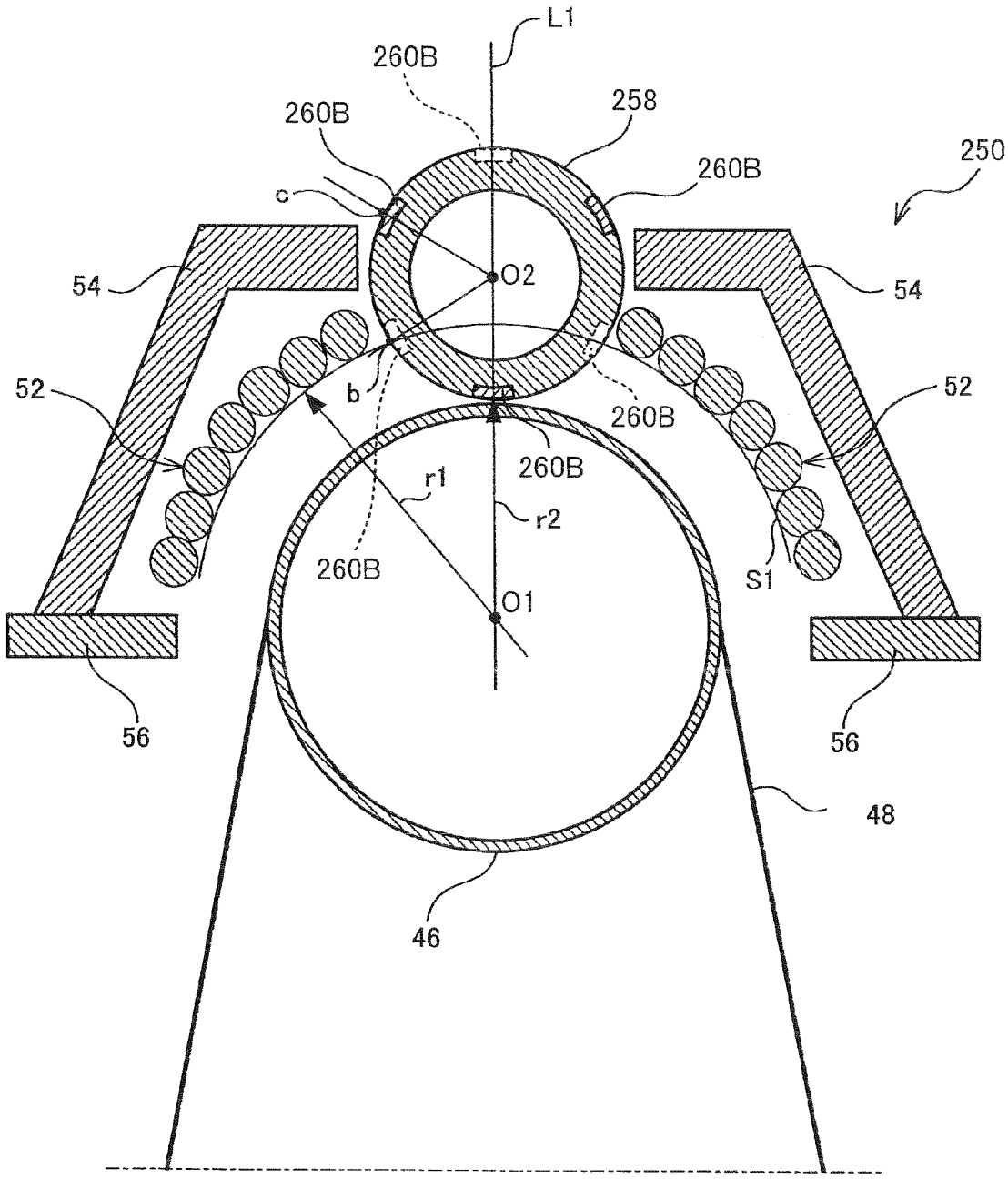
FIG. 17 is a diagram showing structural parameters set in the second embodiment.

In order to satisfactorily obtain the magnetic shielding effect in the structure examples (1) to (3), the following optimal parameters are set for the structure of the IH coil unit 250. FIG. 17 is a diagram showing structural parameters set in the second embodiment. Here is illustrated the shielding members 260B of the structure example (3). A mutual relationship of the parameters is described below.

In light of the structure of the IH coil unit 250, the heating belt 48 has the arcuate outer surface at a position where it is in contact with the heating roller 46. The induction heating coil 52 is arranged on a virtual concentric arcuate surface extending along and outside this arcuate outer surface (S1 in FIG. 17). The center core 258 has a tubular shape centered on its longitudinal axis, and the shielding members 260B bonded to (or embedded in) the outer surface of the center core 258 have an arcuately curved shape. The longitudinal axis (center O2) of the center core 258 is located at a position where a center line of the coil 52 passes. At this time, the following relationships hold.

[Relationship of r1≧r2]

A parameter r1 corresponds to a radius of curvature of the virtual arcuate surface (S1) on which the induction heating coil 52 is arranged. A parameter r2 corresponds to a shortest distance from a center of curvature O1 of the arcuate outer surface of the heating belt 48 to the outer surfaces of the shielding members 260B with the shielding members 260B switched to the shielding positions. At this time, the magnetic field can be reliably shielded at the shielding positions by satisfying the relationship of r1>r2.

[Positional Relationship of a Coil Bottom Surface and End Points "b"]

The positions of end points ("b" in FIG. 17) of the shielding members 260B in the circumferential direction of the center core 258 with the shielding members 260B moved to the shielding position are virtually specified. At this time, the magnetic shielding effect by the shielding members 260B can be satisfactorily exhibited by locating the virtual arcuate surface S1, where the coil 52 is arranged, near the end points "b".

[Positional Relationship of the Arch Cores and End Points "c" ]

As shown by dotted line in FIG. 17, the positions of end points ("c" in FIG. 17) of the shielding members 260B in the circumferential direction of the center core 258 with the shielding members 260B moved to the retracted position are virtually specified. At this time, the shielding members 60 do not hinder the magnetic field during induction heating and can contribute to the realization of a good warm-up environment by locating the arch cores 54 closer to the heating belt 48 or the heating roller 46 than the end points "c".

[Structure Example (4) of the Shielding Member]

Figure 18:
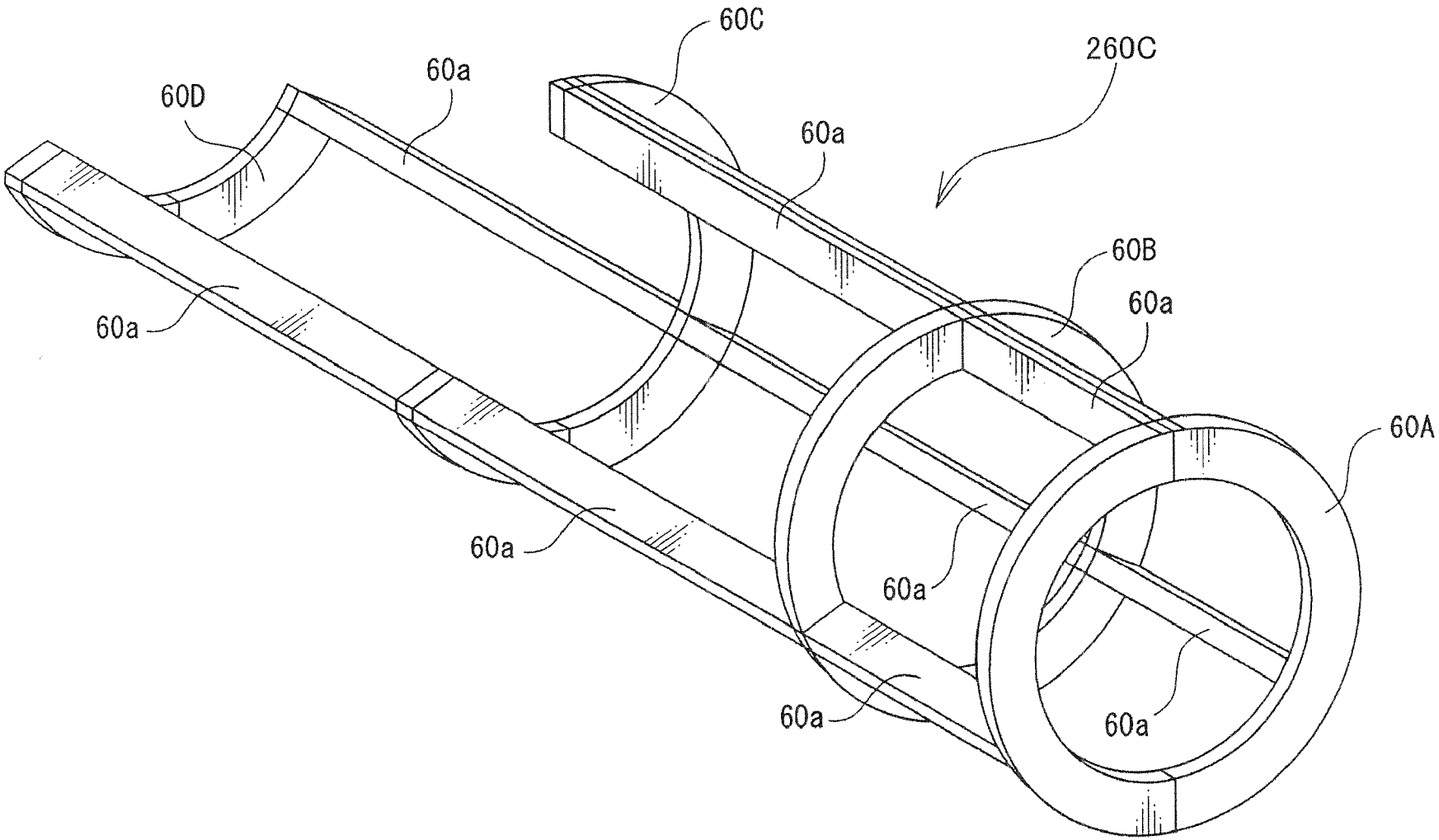
FIG. 18 is a perspective view showing a structure example (4) of the shielding member.

FIG. 18 is a perspective view showing a shielding member 260C according to a structure example (4). The shielding member 260C is the further development of the structure example (3). The shielding member 260C includes a bored disk 60A at one end position in its longitudinal direction and a disk 60B of the same shape distanced from the disk 60A in the longitudinal direction. Following this disk 60B, a bored disk 60C having an about ⅔ circular section and distanced from the disk 60B in the longitudinal direction is disposed, and a bored disk 60D having an about ⅓ circular section is disposed at the other end position.

Out of these four disks 60A to 60D, three disks 60A, 60B and 60C are connected to each other via three straight portions 60*a*. The remaining disk 60D at the other end position is connected to the adjacent disk 60C via the two straight portions 60*a*.

Figure 19A:
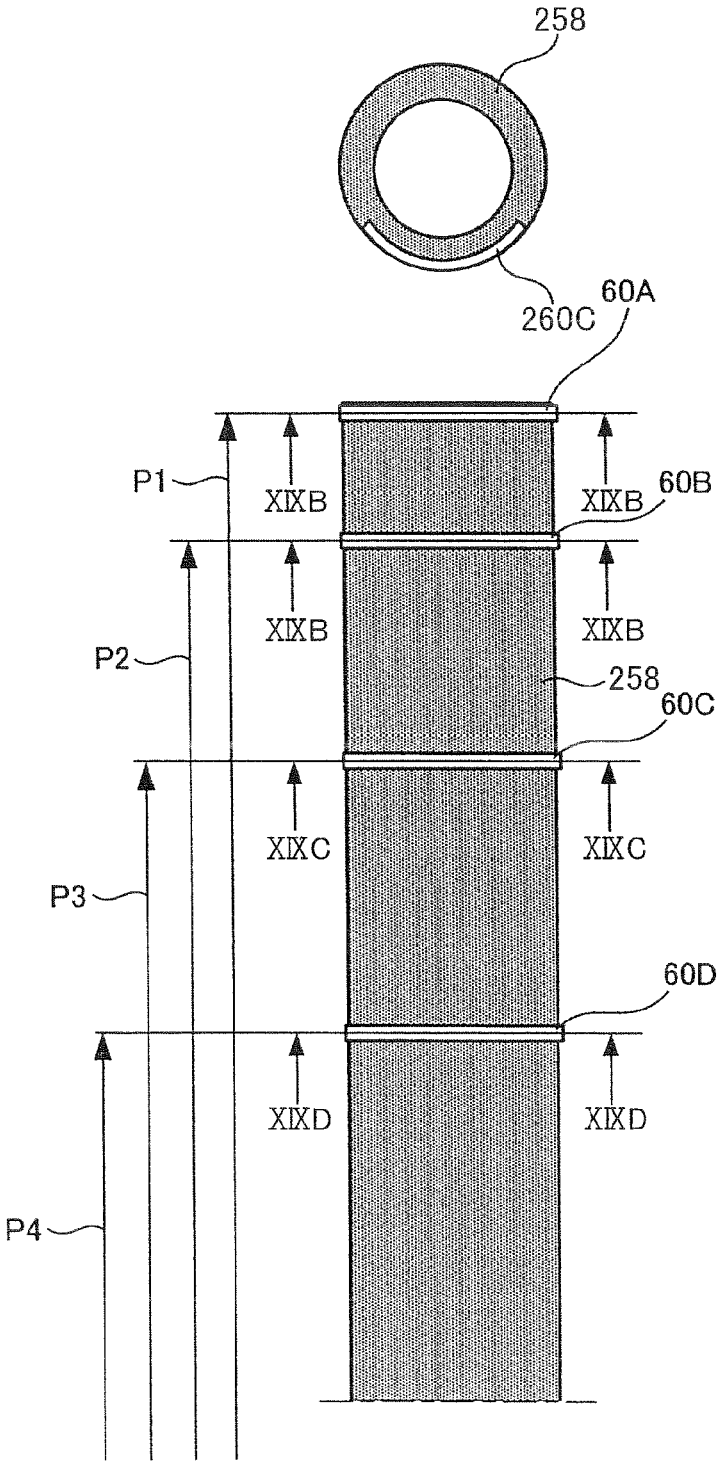
FIG. 19A is a diagram showing a state where the shielding member of the structure example (4) is mounted on a center core (second core)
Figure 19B:
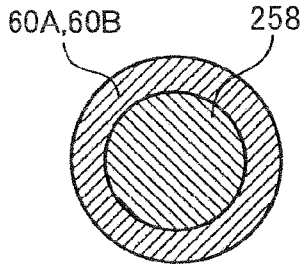
FIGS. 19B, 19C and 19D are respectively sections along XIXB-XIXB, XIXC-XIXC and XIXD-XIXD of FIG. 19A.
Figure 19C:
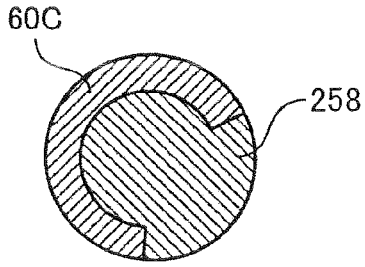
Figure 19D:
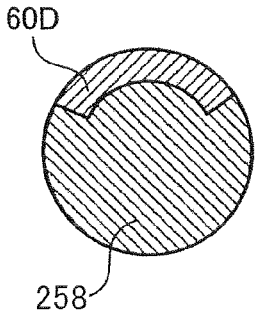

FIG. 19A is a diagram showing a state where the shielding member 260C of the structure example (4) is mounted on the center core 258, FIGS. 19B, 19C and 19D are respectively sections along XIXB-XIXB, XIXC-XIXC and XIXD-XIXD. The shielding member 260C is formed integral to the center core 258 by insert molding as a whole, but the circumferential surfaces of the disks 60A to 60D are slightly exposed at the outer surface of the center core 258.

As shown in FIG. 19A, the shielding member 260C of the structure example (4) is also disposed at a longitudinal end of the center core 258. At this time, the disk 60A most distant from the minimum paper area is at a position corresponding to a maximum size P1 (e.g. A3 or A4R size); the next disk 60B at a position corresponding to a middle size P2 (e.g. B4 size); and the next disk 60C at a position corresponding to a middle-small size P3 (e.g. B4 size). The disk 60D near the minimum paper area is at a position corresponding to a minimum size P4 (e.g. A5R size).

As shown in FIG. 19B, the disks 60A, 60B have a complete annular shape. As shown in FIG. 19C, the disk 60C has an incomplete annular shape of the about ⅔ circle as described above. The ferrite material of the center core 258 is filled in a lacking part of the disk 60C. As shown in FIG. 19D, the disk 60D has a truncated fan shape of the about ⅓ circle as described above. The ferrite material of the center core 258 is also filled in a lacking part of the disk 60D.

[Operation Examples of the Structure Example (4)]

FIGS. 20 to 25 are perspective views successively showing six operation examples in the case of employing the shielding member 260C of the structure example (4). Thick line arrow(s) shown in each of FIGS. 20 to 25 indicate(s) a generated induction current or a passing magnetic field. They are respectively described below.

[Complete Shielding (0°)]

Figure 20:
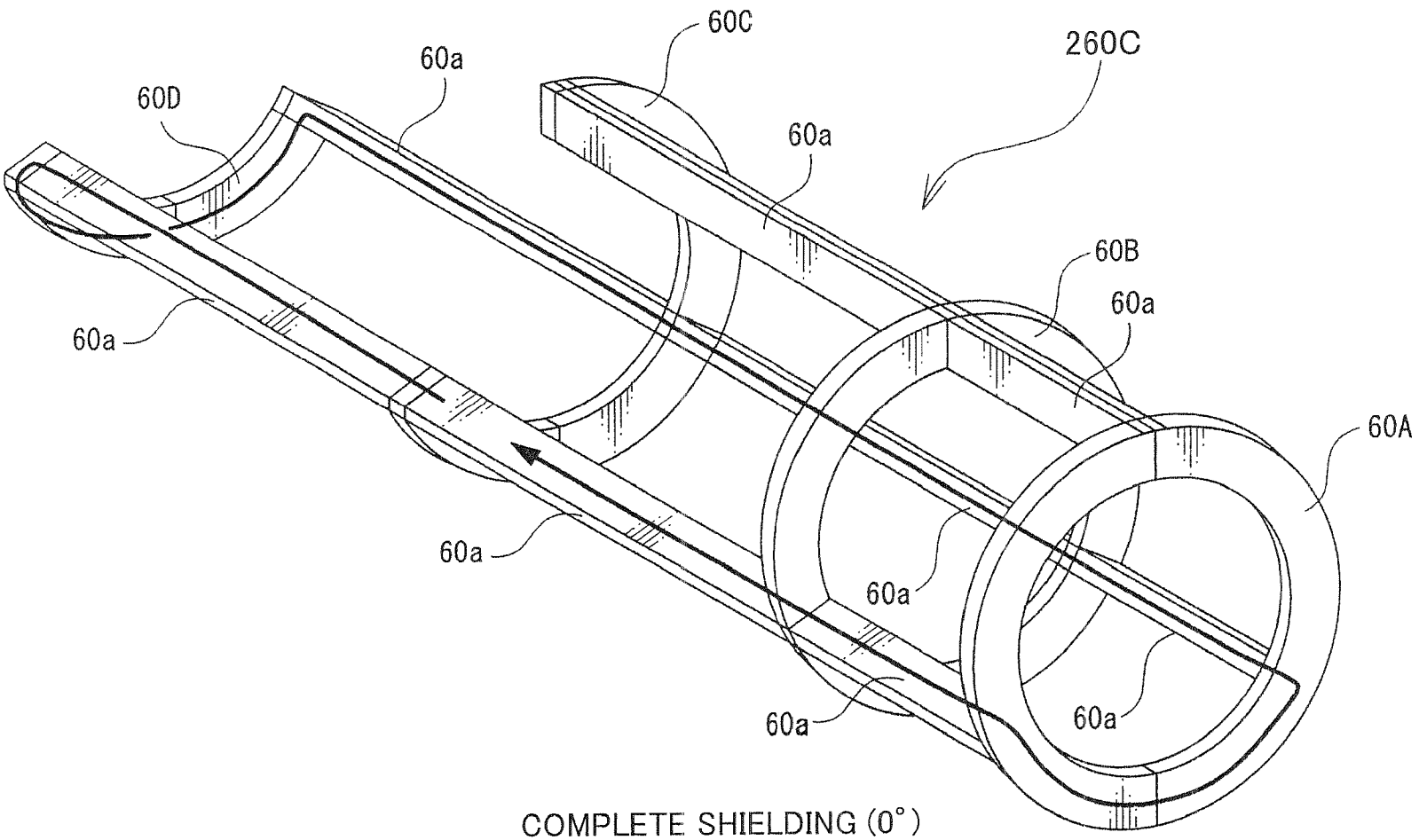
FIG. 20 is a perspective view showing an operation example in the case of complete shielding by the shielding member of the structure example (4)

First of all, FIG. 20 is the perspective view showing an operation example in the case of complete shielding by the shielding member 260C. It is assumed in each operation example that a magnetic field is generated in such a direction as to penetrate the shielding member 260C from upper side to lower side. In the following description, it is assumed that a state of complete shielding shown in FIG. 20 is 0° and the displacement amount of the shielding member 260C is expressed by an angle of rotation from 0°.

If the shielding member 260C is moved to an angle of rotation (0°) at which the disk 60D is located at the bottom as the center core 258 is rotated, the magnetic shielding effect can be exhibited by the entire surface of the shielding member 260C in the longitudinal direction. In other words, since a maximum closed frame is formed by the disk 60A at the one end position, the disk 60D at the other end position and the straight portions 60*a* connecting these, the shielding member 260C can entirely shield magnetism. In this case, the overheating of the heating belt 48 and the heating roller 46 can be prevented in correspondence with the minimum size P4.

[No Shielding (60°)]

Figure 21:
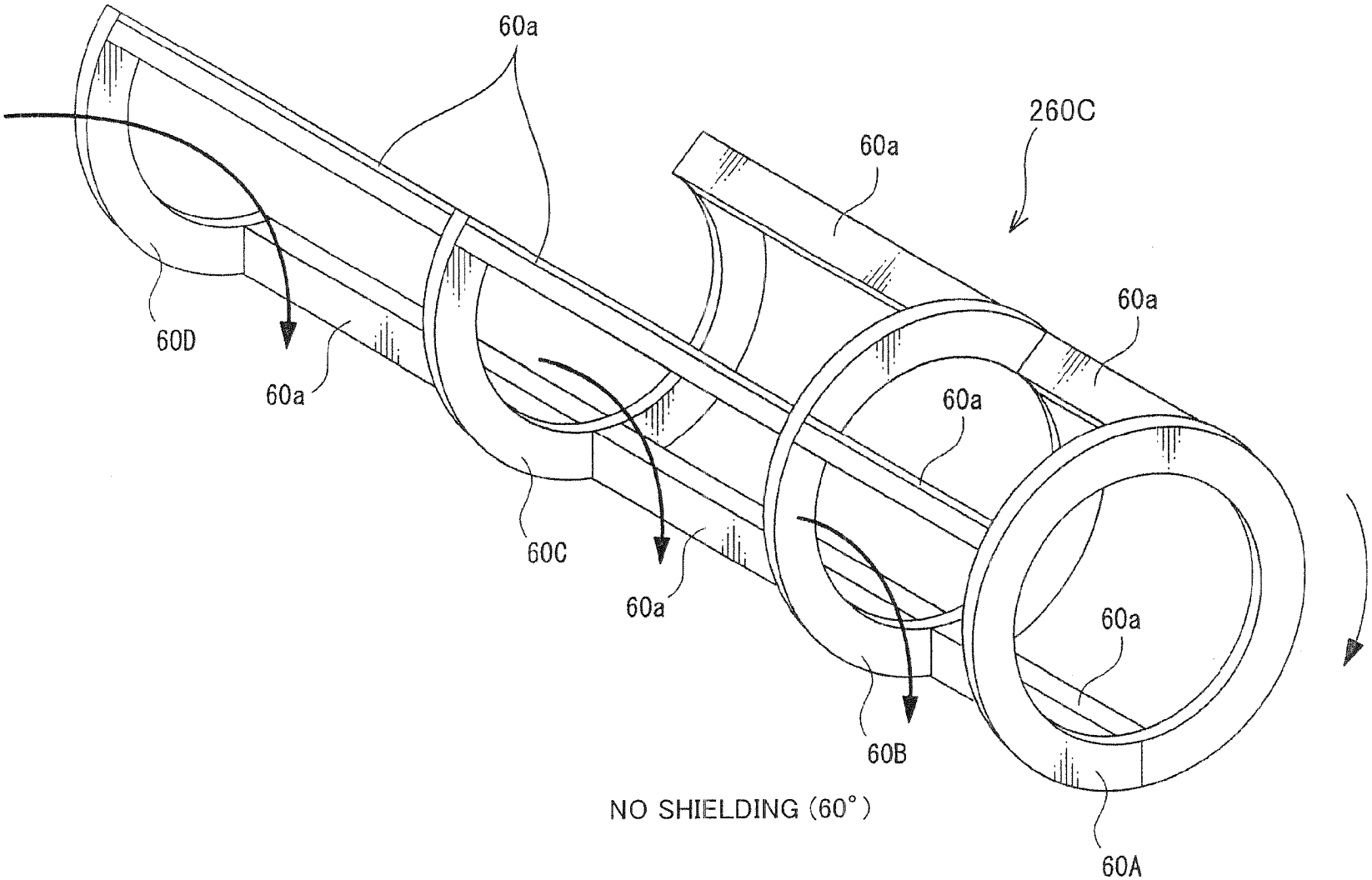
FIGS. 21, 22, 23, 24 and 25 are perspective views showing operation examples when the shielding member is rotated by 60°, 120°, 180°, 240° and 300° in a clockwise direction from a state of FIG. 20.

FIG. 21 is the perspective view showing an operation example when the shielding member 260C is rotated in the clockwise direction by 60° from the state of FIG. 20. In this case, since the straight portion 60*a* is located on the center line of the coil 52 (state equivalent to the state of FIG. 16A), the shielding member 260C is at the retracted position and exhibits no magnetic shielding effect.

[Middle-Small Size Shielding (120°)]

Figure 22:
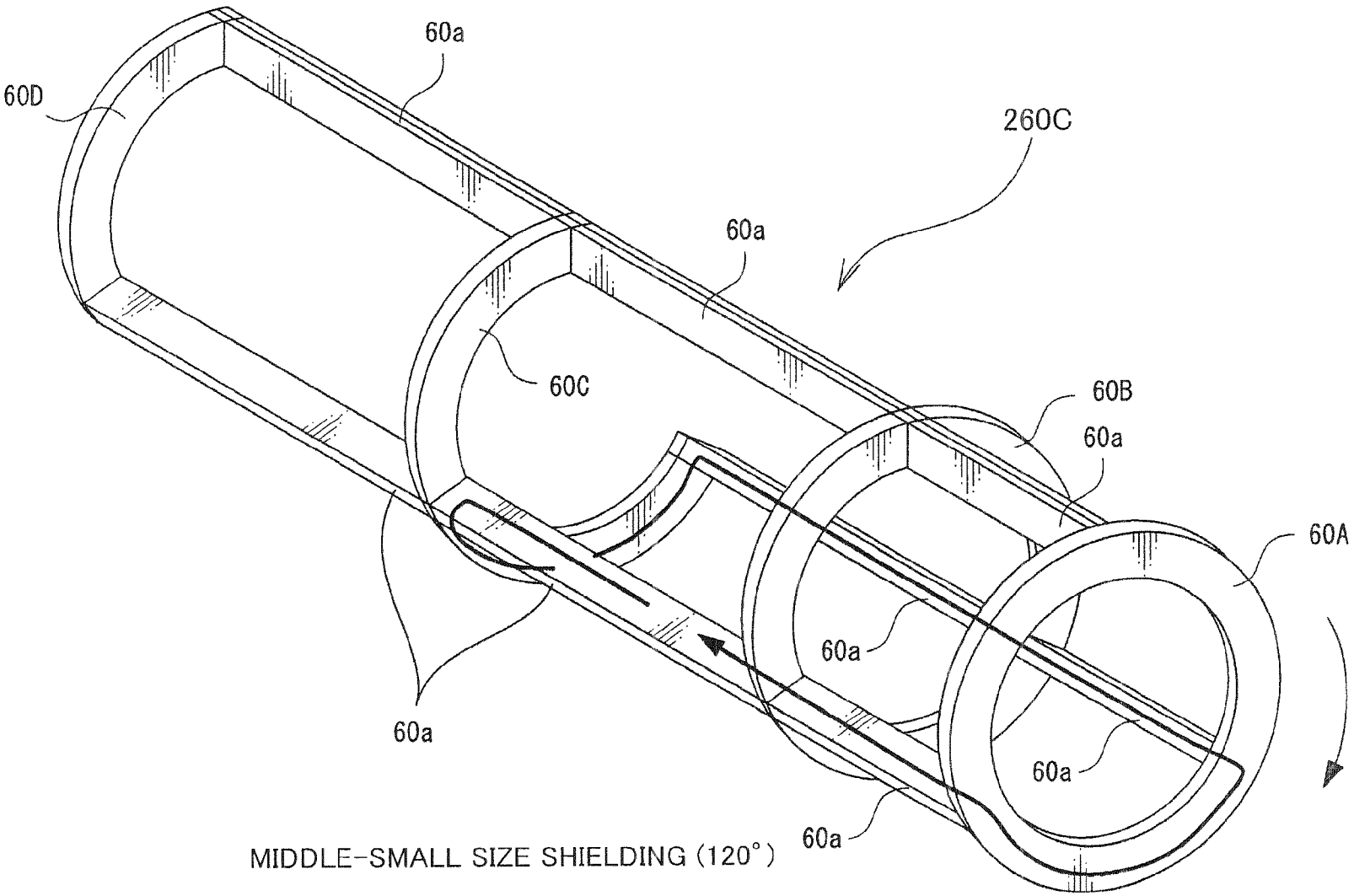

FIG. 22 is the perspective view showing an operation example when the shielding member 260C is rotated in the clockwise direction by 120° from the state of FIG. 20. In this case, one closed frame formed between the disks 60A and 60C can exhibit the magnetic shielding effect. In this operation example, the overheating of the heating belt 48 and the heating roller 46 can be prevented, for example, in correspondence with the middle-small size P3.

[No Shielding (180°)]

Figure 23:
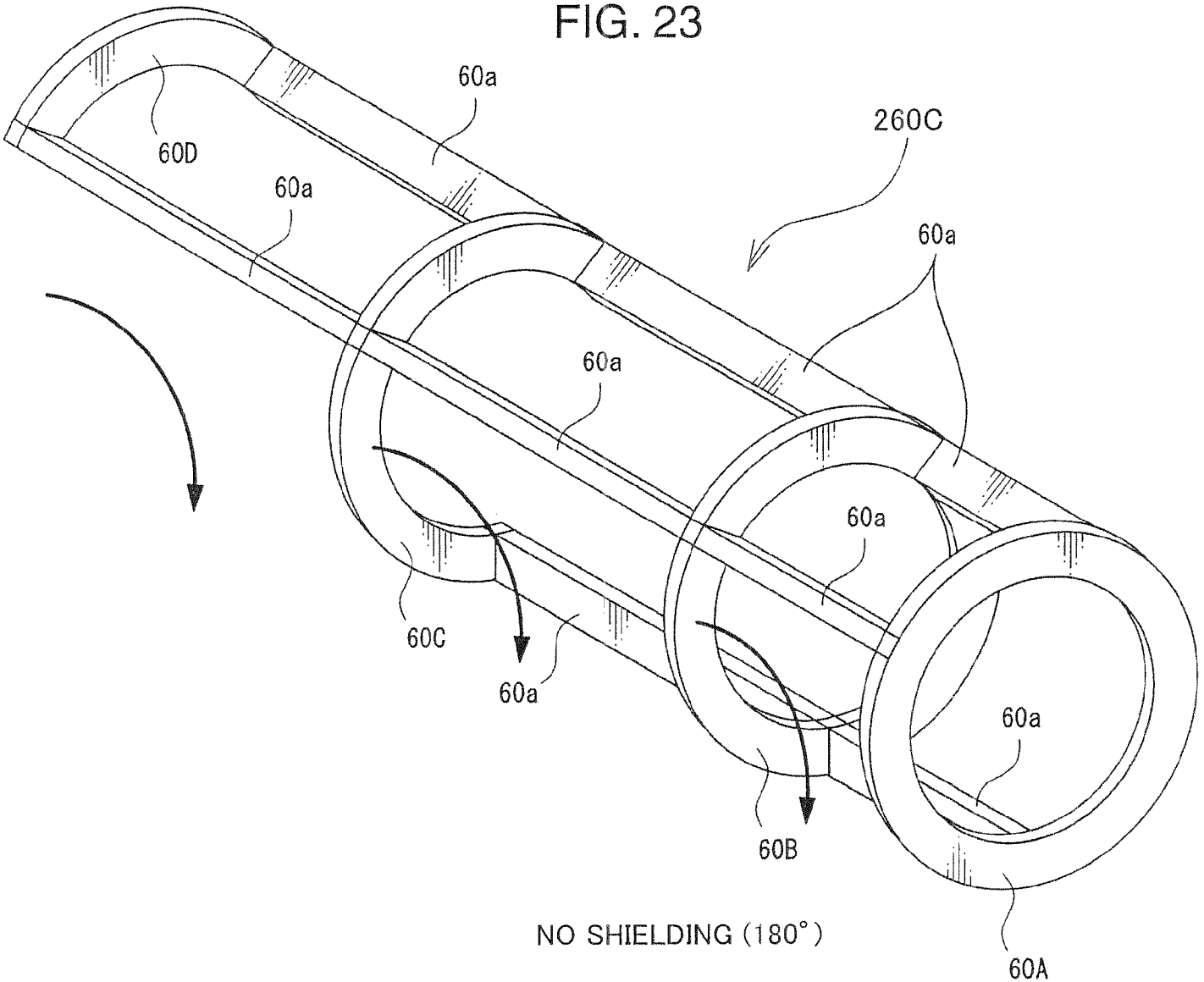

FIG. 23 is the perspective view showing an operation example when the shielding member 260C is rotated in the clockwise direction by 180° from the state of FIG. 20. In this case, since the straight portion 60*a* is located on the center line of the coil 52 (state of FIG. 16A) as in FIG. 21, the shielding member 260C is at the retracted position and exhibits no magnetic shielding effect.

[Middle Size Shielding (240°)]

Figure 24:
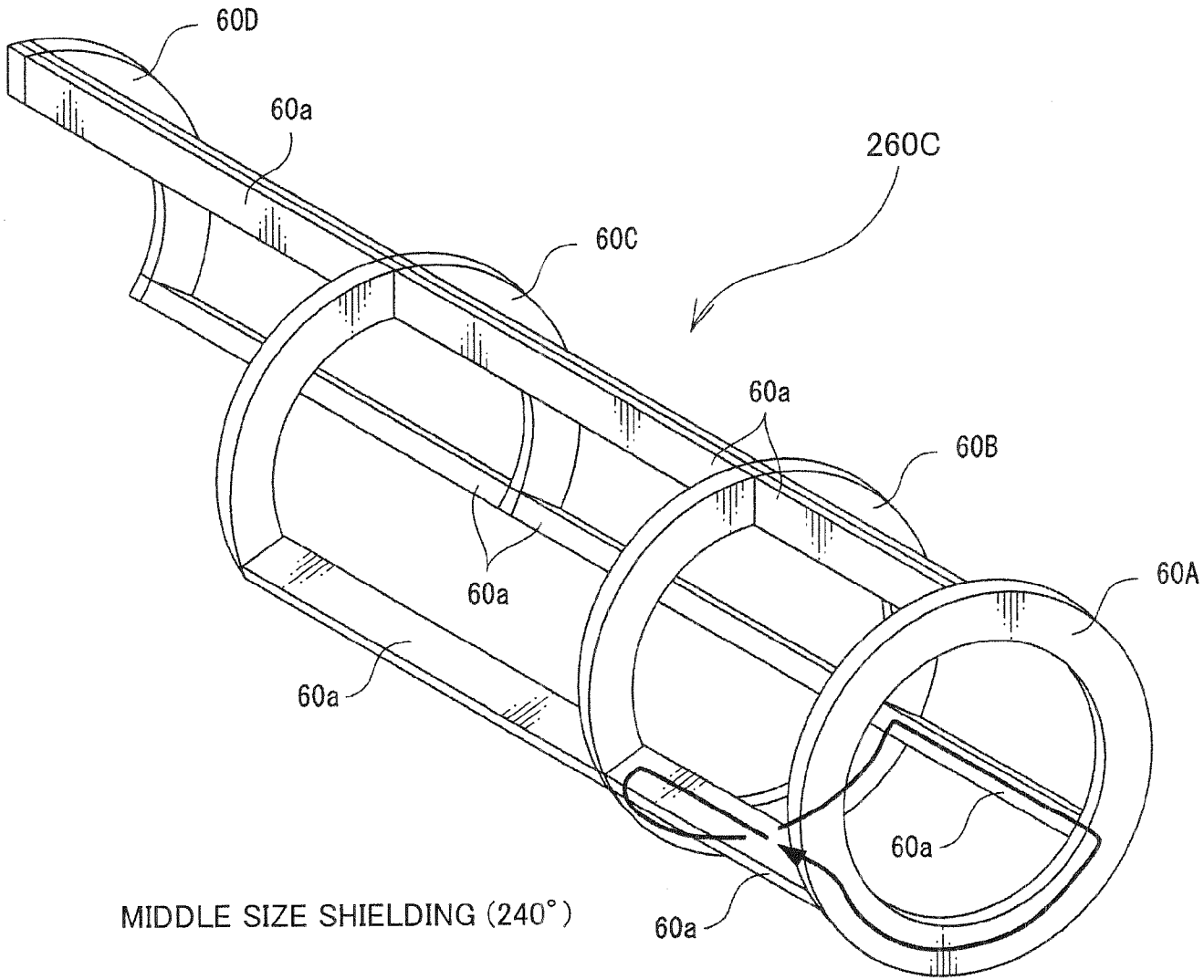

FIG. 24 is the perspective view showing an operation example when the shielding member 260C is rotated in the clockwise direction by 240° from the state of FIG. 20. In this case, one closed frame formed between the disks 60A and 60B can exhibit the magnetic shielding effect. In this operation example, the overheating of the heating belt 48 and the heating roller 46 can be prevented, for example, in correspondence with the middle size P2.

[No Shielding (300°)]

Figure 25:
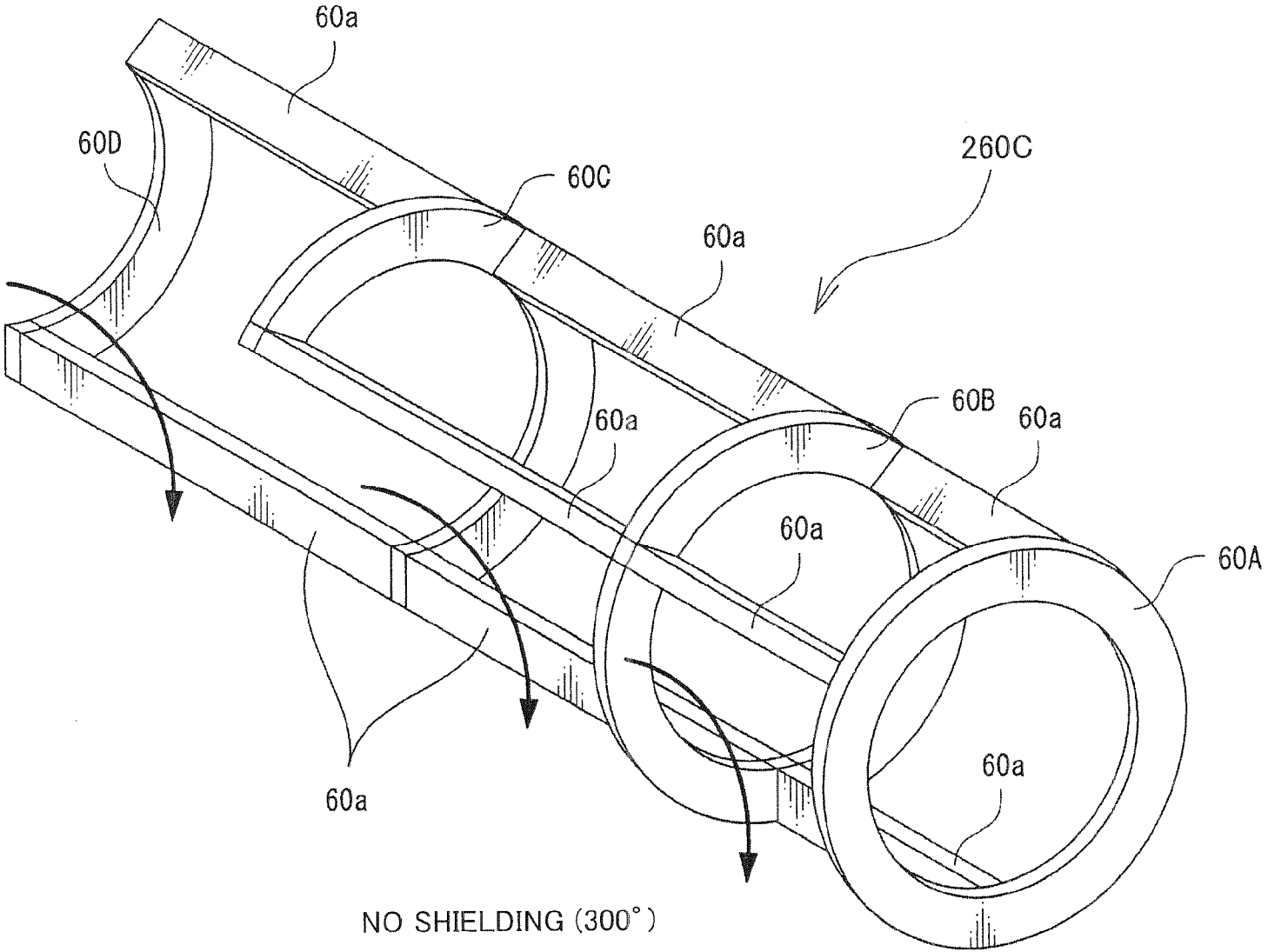

FIG. 25 is the perspective view showing an operation example when the shielding member 260C is rotated in the clockwise direction by 300° from the state of FIG. 20. In this case, since the straight portion 60*a* is located on the center line of the coil 52 as in FIGS. 21 and 23, the shielding member 260C is at the retracted position and exhibits no magnetic shielding effect. In the case of no shielding (60°), (180°) and (300°), the heating belt 48 and the heating roller 46 can be heated by induction in correspondence with the maximum size P1.

[First Modification]

Figure 26:
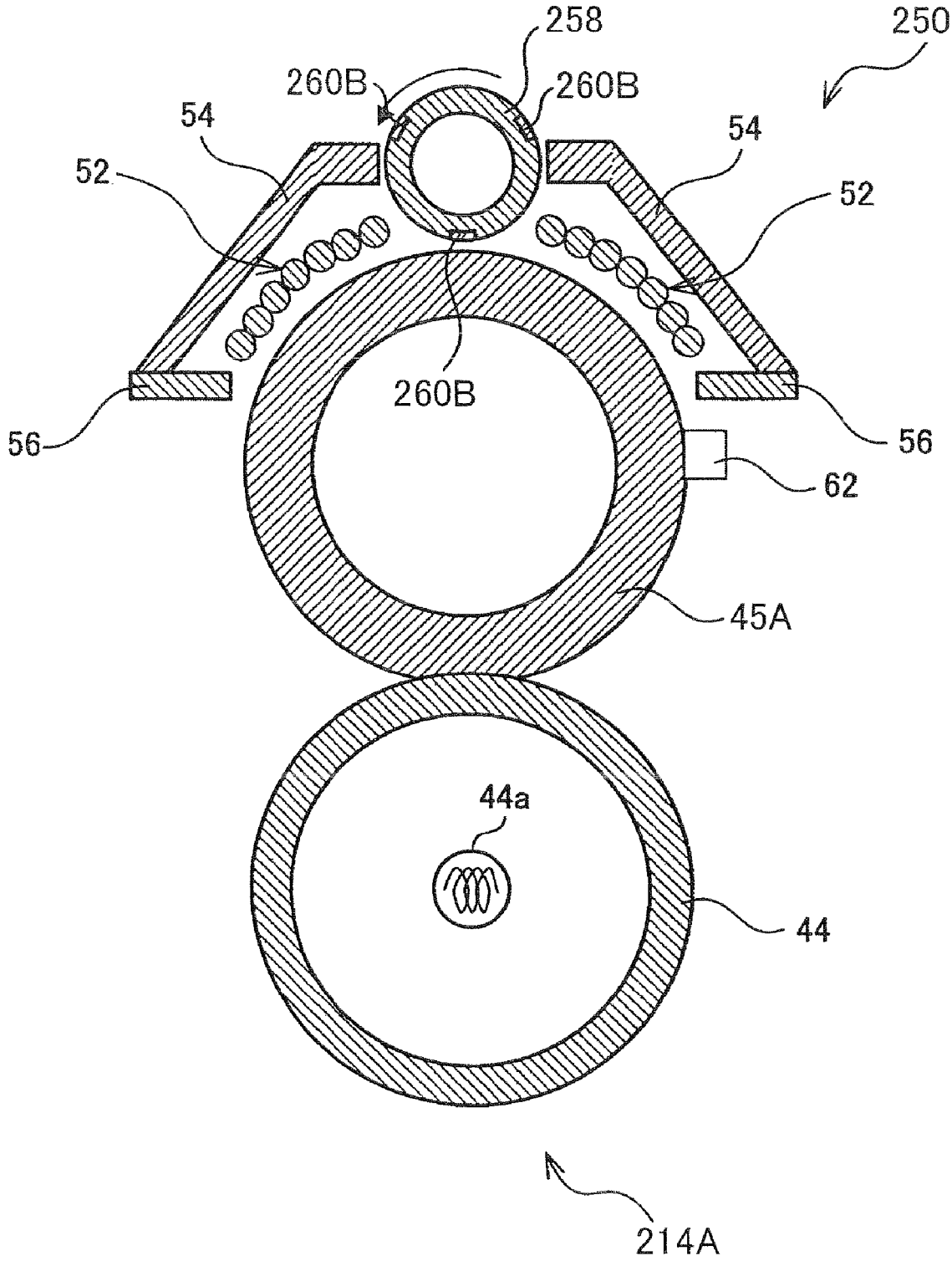
FIG. 26 is a diagram showing a first modification of the second embodiment.

FIG. 26 is a diagram showing a fixing unit 214A according to a first modification of the second embodiment. In this fixing unit 214A, a toner image is fixed by the fixing roller 45A and the pressure roller 44 without using the above heating belt 48. The IH coil unit 250 is arranged to face the circumferential surface of this fixing roller 45A.

A magnetic body similar to that of the above heating belt is, for example, wound around the outer circumferential surface of the fixing roller 45A, and the magnetic body is induction heated by the induction heating coil 52. In this case, the thermistor 62 is disposed at a position outside the fixing roller 45A to face a magnetic body layer. The other construction is similar to the above and the shielding members 260B can be moved to the shielding positions and the retracted positions by rotating the center core 58.

[Second Modification]

Figure 27:
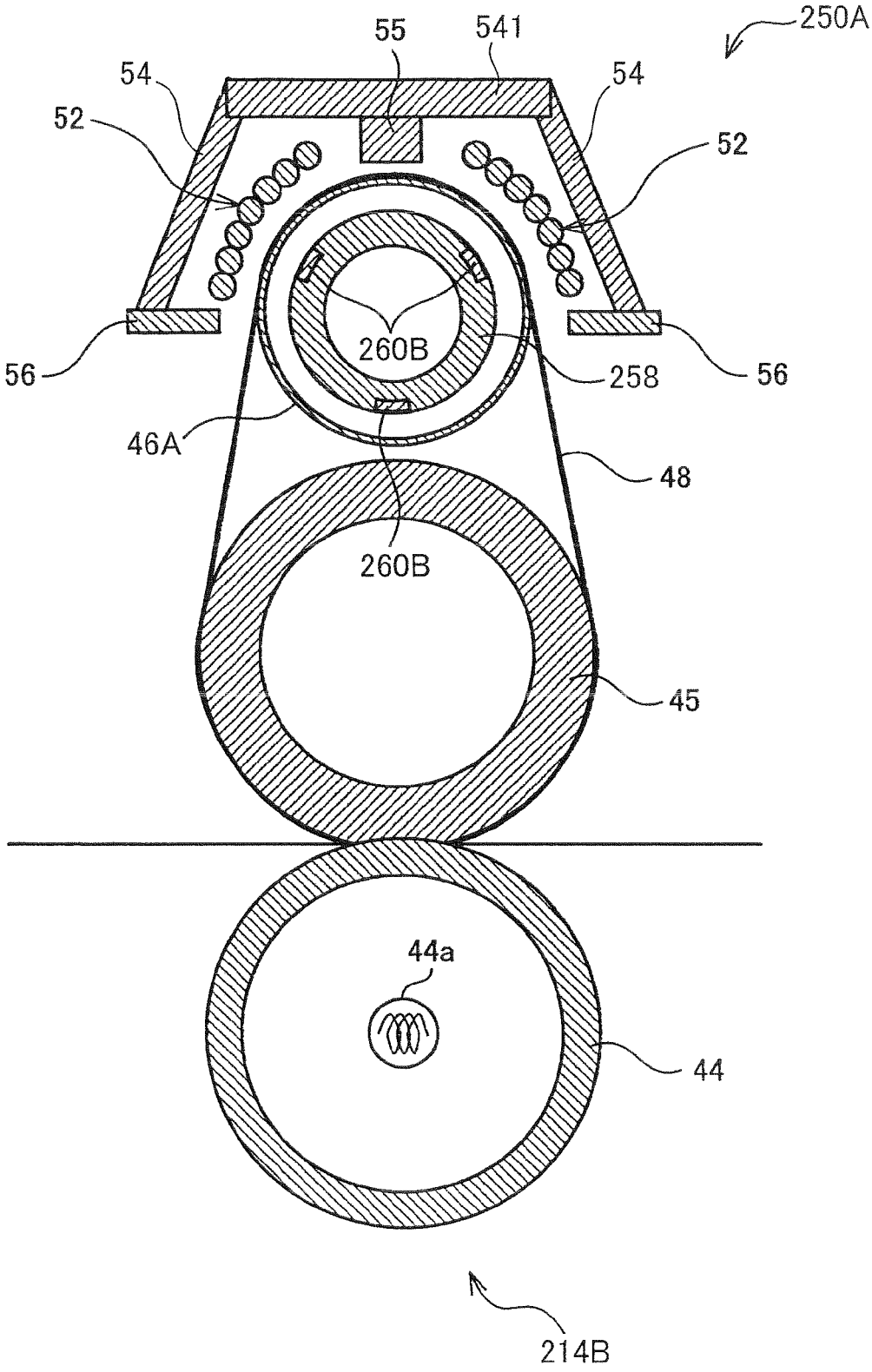
FIG. 27 is a diagram showing a second modification of the second embodiment.

FIG. 27 is a diagram showing a fixing unit 214B according to a second modification of the fixing unit 214 of the second embodiment. This fixing unit 214B differs from the above embodiment in that a heat roller 46A is made of a nonmagnetic metal (e.g. SUS: stainless steel) and that the center core 258 is arranged inside the heating roller 46A. Further, in an IH coil unit 250A, two arch cores 54 are connected by an intermediate piece 541 made of a magnetic metal and an intermediate core 55 is disposed below the intermediate piece 541.

Since the heating roller 46 is made of the nonmagnetic metal, the magnetic field generated by the induction heating coil 52 passes the side cores 56, the arch cores 54, the intermediate piece 541 and the intermediate core 55 and reaches the center core 258 inside after penetrating through the heating roller 46. The heating belt 48 is induction-heated by the penetrating magnetic field.

In such a structure example, if the closed frames of the shielding members 260B are switched to positions (shielding positions) to face the intermediate core 55 as shown in FIG. 27, magnetism is shielded to suppress an excessive temperature increase outside the paper area. On the other hand, if the shielding members 260B are at the retracted positions where magnetism does not penetrate through the closed frames of the shielding members 260B, the magnetic shielding effect does not work and the heating belt 48 is induction heated in the maximum paper area in this case.

[Third Modification]

Figure 28:
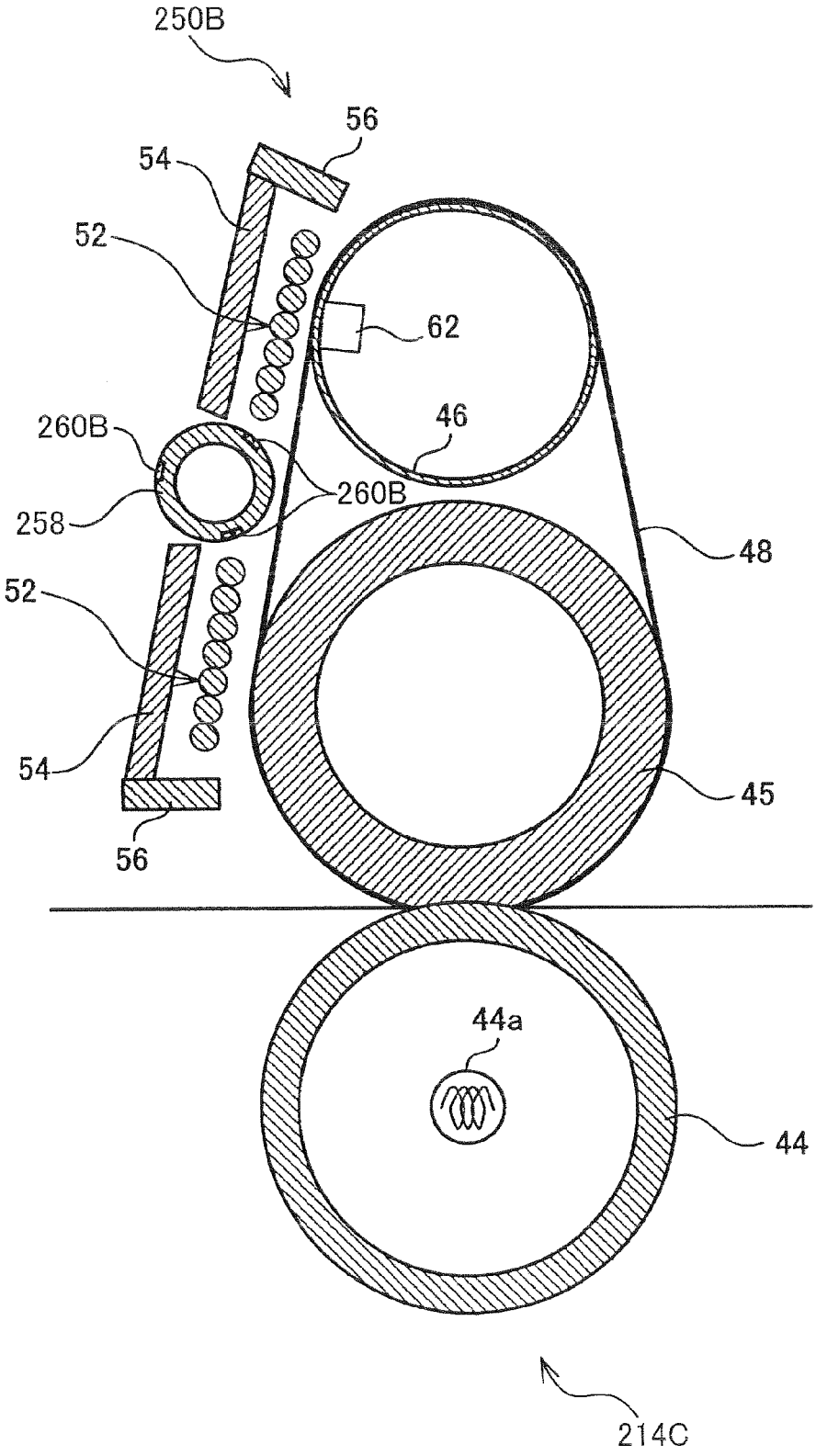
FIG. 28 is a diagram showing a third modification of the second embodiment.

FIG. 28 is a diagram showing a fixing unit 214C according to a third modification of the fixing unit 214 of the second embodiment. In this example, an IH coil unit 250B having a different mode is used. In this construction example, the IH coil unit 250B performs induction heating not at a position facing the arcuate part of the heating belt 48, but at a position facing a flat part of the heating belt 48 between the heat roller 46 and the fixing roller 45. In this case as well, the magnetism can be similarly shielded by rotating the center core 258.

The various embodiments of the present invention are described above, but the present invention is not limited to the above embodiments and can be embodied in various modifications. For example, the shape of the center cores 58 (258) is not limited to a tubular or cylindrical shape and may be a polygonal shape. Further, the shapes of the closed frames of the shielding members 60 (260) in plan view are not limited to trapezoidal and rectangular shapes and may be triangular shapes.

Besides, the specific shapes of the respective parts including the arch cores 54 and the side cores 56 are not limited to the shown ones and can be appropriately modified.

The above specific embodiments mainly embrace inventions having the following constructions.

An image forming apparatus according to one aspect of the present invention comprises an image forming station for transferring a toner image to a sheet; and a fixing unit including a heating member and a pressing member and adapted to convey the sheet while sandwiching sheet between the heating member and the pressing member and to fix the toner image to the sheet by heat at least from the heating member in a conveyance process, wherein the fixing unit includes a coil for generating a magnetic field for induction heating the heating member; a first core made of a magnetic material and fixedly arranged around the coil to form a magnetic path around the coil; a second core made of a magnetic material, arranged between the first core and the heating member in a generation direction of the magnetic field by the coil to form the magnetic path in cooperation with the first core and capable of changing a posture thereof; a shielding member made of a nonmagnetic metal and arranged along the outer surface of the second core to shield magnetism in the magnetic field generated by the coil; and a magnetic shielding portion for changing the posture of the second core between a first posture where the shielding member shields the magnetism and a second posture where the shielding member does not shield the magnetism.

According to this construction, since a method (external IH) for heating and melting a toner image by induction heating the heating member by the magnetic field generated by the coil is employed, it is not necessary to dispose a special member inside the heating member. Further, the first core is arranged around the coil to form the magnetic path for introducing the magnetic field generated by the coil and the second core is merely interposed between the first core and the heating member, wherefore there is no likelihood of inadvertently enlarging a space taken up by the fixing unit as a whole.

Since a mechanism for magnetic shielding needs not to be provided inside the heating member to enable a lower heat capacity in this way, the warm-up time of the fixing unit can be shortened. Further, since only the second core is moved as a movable part to change its posture even if the external IH is employed, a movable range can be made smaller as a whole and the fixing unit and consequently the entire image forming apparatus can be accordingly miniaturized.

In the above construction, it is preferable that the second core is a member which changes its posture by being rotated about a longitudinal axis intersecting with a passing direction of the magnetic field generated by the coil; and that the magnetic shielding portion includes a rotating mechanism for changing the posture of the second core between the first posture and second posture by rotating the second core about the longitudinal axis.

According to this construction, if the second core is set to the first posture by being rotated, the magnetic field generated by the coil is introduced to the first and second cores to generate an eddy current in the heating member, thereby performing magnetic induction heating. On the other hand, if the second core is set to the second posture, magnetic resistance in the magnetic path increases to reduce magnetic field intensity and the amount of heat generation by the heating member can be reduced. Thus, it is not necessary to distance the cores from the heating member upon adjusting the amount of the heat generation by the heating member and space-saving can be promoted by that much.

In the above construction, it is preferable that the coil is arranged along the outer surface of the heating member; that the first core is spaced apart from the heating member with the coil located therebetween and includes an entrance and an exit of the magnetic path; that the second core is a member capable of forming an intermediate magnetic path between the entrance or exit of the magnetic path and the heating member; and that at least a part of the intermediate magnetic path is blocked by the shielding member when the second core is in the first posture while the intermediate magnetic path is not substantially blocked when the second core is in the second posture.

In the above construction, it is preferable to further comprise a controller for changing a magnetic shielding amount by the shielding member by controlling a rotation amount of the second core by the rotating mechanism. A "change in the shielding amount" in this case is preferably a change of increasing or decreasing the shielding amount stepwise or continuously according to an angle of rotation (rotational displacement amount) of the second core. In this way, the amount of heat generation by the heating member can be more easily controlled.

In the above construction, it is preferable that the heating member has a first area, with which a maximum one of sheets to be conveyed by the fixing unit comes into contact, induction-heated by the coil; that the second core extends in a direction of the longitudinal axis to form the magnetic path in an entire area in a width direction of the heating member; and that the shielding member is disposed outside a second area, with which a minimum one of sheets to be conveyed by the fixing unit comes into contact, in the longitudinal axis direction of the second core.

According to this construction, if the shielding member is switched to a shielding position (first position) and a retracted position (second posture) by rotating the second core according to a sheet size, excessive temperature increases of the heating member and the like can be prevented when it is not necessary to heat outer sides of a minimum paper area.

In the above construction, if a ratio of the length of the shielding member to the outer circumferential length of the second core in a rotating direction of the second core is a covering ratio, the covering ratio preferably differs in the longitudinal axis direction and is set relatively smaller near the second area.

According to this construction, when the shielding member is switched to the shielding position, the magnetic shielding amount is decreased where the covering ratio is small and, conversely, is increased where the covering ratio is large. By setting the covering ratio to differ along the longitudinal axis direction of the second core in this way, the magnetic shielding amount can be changed in the longitudinal axis direction (sheet width direction). Particularly, if the covering ratio differs stepwise or continuously in the longitudinal axis direction, a range where the heating member is induction heated can be changed stepwise or continuously by finely adjusting the angle of rotation of the second core.

In the above construction, it is preferable to set specific shapes and geometric parameters in the following (1) to (3) for various members.

(1) It is preferable that the heating member at least partially has an arcuate outer surface; that the coil is arranged on a virtual arcuate surface extending along, outside and concentric with the arcuate outer surface of the heating member; that the second core has a tubular or cylindrical shape centered on the longitudinal axis thereof; that the shielding member is arcuately curved along the outer surface of the second core; and that a relationship of $r1 \geqq r2$ holds if $r1$ denotes a radius of curvature of the virtual arcuate surface on which the coil is arranged and $r2$ denotes a shortest distance from a center of curvature of the arcuate outer surface of the heating member to the outer surface of the shielding member with the second core set in the first posture.

Since the shielding member can be located closer to the heating member than the coil at the shielding position by setting the above conditions, magnetism can be more reliably shielded when the shielding member is moved to the shielding position.

(2) In addition to the above (1), a relationship of $\theta 2 \geqq \theta 1$ preferably holds if $\theta 1$ denotes an angle between a virtual straight line connecting the center of curvature of the arcuate outer surface of the heating member and a center of the second core and a straight line connecting the center of the second core and an intersection of the outer surface of the second core and the virtual arcuate surface on which the coil is arranged and $\theta 2$ denotes an angle between the virtual straight line and a straight line connecting the center of the second core and an end point of the shielding member with the shielding member set in the first posture.

If the second core has a tubular or cylindrical shape in the above (1), the shielding member arranged along the outer surface of the second core has an arcuate shape. In this case, the above shortest distance $r2$ satisfies the above relationship at a position where the shielding member is located closest to the outer surface of the heating member, but a distance between the shielding member and the heating member increases as the shielding member is circumferentially distanced from this position. Even in such a situation, if the shielding member is provided up to the position of the angle $\theta 2$ equal to or larger than the angle $\theta 1$ with respect to the center of the second core, a magnetic shielding function by the shielding member can be sufficiently fulfilled.

(3) In addition to the above (2), it is preferable that the first core is formed with a virtual plane orthogonal to a virtual line connecting the center of curvature of the arcuate outer surface of the heating member and the center of the second core at the center of the second core as a center; and that the end point of the shielding member in a circumferential direction of the second core is set at a position more distant from the arcuate outer surface of the heating member than the virtual plane with the second core set in the second posture.

If the shielding member has an arcuate shape as described in the above (2), there is a possibility of shielding the magnetic path at the position of the end position even if the shielding member is moved to the retracted position (second posture). Accordingly, by setting the position of the end point of the shielding member more distant from the heating member than the center of the first core with the shielding member moved to the retracted position, a structure can be built which does not shield magnetism at the retracted position. Therefore, the induction heating efficiency of the heating member is not hindered, which can accordingly contribute to the shortening of the warm-up time.

In the above construction, it is preferable that the shielding member includes a closed frame portion; that the magnetic field generated by the coil penetrates through the closed frame portion of the shielding member when the second core is in the first posture while passing the outside the closed frame portion of the shielding member when the second core is in the second posture.

According to this construction, when the second core is set to the second posture, the magnetic field generated by the coil is introduced to the first and second cores to generate an eddy current in the heating member, thereby performing magnetic induction heating. On the other hand, when the second core is set to the first posture, magnetic resistance in the magnetic path increases to reduce magnetic field intensity and the amount of heat generation of the heating member can be reduced. Therefore, it is not necessary to distance the cores from the heating member upon adjusting the amount of heat generation of the heating member and space-saving can be promoted by that much.

Further, since the shielding member includes the closed frame portion, if a perpendicular magnetic field (interlinkage flux) penetrates through an inner plane of the closed frame portion, an induction current is generated in a circumferential direction of the closed frame portion and an opposite magnetic field in a direction opposite to the penetrating magnetic field is generated from the generated induction current. This opposite magnetic field cancels the magnetic field (interlinkage flux) penetrating the inside of the closed frame portion in a perpendicular direction, whereby the shielding member can shield magnetism. On the other hand, no induction current is generated if magnetic fields pass in both directions inside the closed frame portion or a magnetic field passes while making a U-turn inside the closed frame portion, wherefore no magnetic shielding effect is exhibited. Attention is focused on such a property of the shielding member, the magnetic shielding effect is produced by arranging the shielding member such that magnetism penetrates inside the closed frame portion at the shielding position (first posture) while magnetism does not penetrate inside the closed frame portion at the retracted position (second posture).

In this construction, it is preferable that the second core changes the posture thereof by being rotated about a longitudinal axis intersecting with a passing direction of the magnetic field generated by the coil; and that the magnetic shielding portion includes a rotating mechanism for changing the posture of the second core between the first and second postures by rotating the second core about the longitudinal axis. According to this construction, the shielding member can be freely moved to the shielding position and to the retracted position only by rotating the second core. Therefore, a mechanism for moving the shielding member is simplified, which can further contribute to space saving.

In the above construction, it is preferable that the shielding member has one rectangular frame shape with a common outer peripheral part; and that the inside of the rectangular frame is divided into a plurality of parts in the longitudinal direction of the heating member. The shielding member exhibits magnetic shielding effect within the range of the inside of the frame. Thus, if the shielding member is divided into a plurality of frames, sheets of various sizes can be dealt with by combining the frames for exhibiting the magnetic shielding effect.

In the above construction, it is preferable that the coil is arranged along the outer surface of the heating member; the first core is arranged while being divided into parts at the opposite sides of a center along the outer surface of the coil; and that the second core is arranged at a position where magnetic paths join at the center of the coil via the divided parts of the first core. According to this construction, the movable core is located in the center of the magnetic path, wherefore magnetic shielding and magnetic passage can be efficiently switched by one movable core.

In the above construction, it is preferable to set specific shapes and geometric parameters in the following (4) to (6) for various members.

(4) It is preferable that the heating member at least partially has an arcuate outer surface; that the coil is arranged on a virtual arcuate surface extending along, outside and concentric with the arcuate outer surface of the heating member; that the second core has a tubular or cylindrical shape; that the shielding member is arcuately curved along the outer surface of the second core; and that a relationship of r1>r2 holds if r1 denotes a radius of curvature of the virtual arcuate surface on which the coil is arranged and r2 denotes a shortest distance from a center of curvature of the arcuate outer surface of the heating member to the outer surface of the shielding member with the shielding member switched to the shielding position.

Since the shielding member can be located closer to the heating member than the coil at the shielding position by setting the conditions of the above (4), magnetism can be more reliably shielded when the shielding member is moved to the shielding position.

(5) The virtual arcuate surface on which the coil is arranged is preferably located at a position near an end point of the shielding member in a circumferential direction of the second core with the second core is set in the first posture. Since the shielding member can be located close to the coil at the shielding position, the shielding effect by the shielding member can be satisfactorily exhibited.

(6) The first core is preferably located at a position closer to the heating member than an end point of the shielding member in the circumferential direction of the second core with the second core set in the second posture. This can prevent the magnetic field (magnetic flux) leaking from the fixed core when the shielding member is moved to the retracted position from being shielded by the shielding member, which can contribute to the realization of a good warm-up environment in cooperation with the condition of the above (5).

In the above construction, it is preferable that a temperature controller for controlling an induction heated state of the heating member by the coil is further provided; that the temperature controller includes a temperature responding element arranged along the inner circumferential surface of the heating member for responding to the temperature of the heating member; and that the operation of the coil is controlled based on a response result of the temperature responding element. Here, the "temperature responding element" is a temperature responding device such as a thermistor or a thermostat.

Since no magnetic shielding mechanism is provided inside the heating member according to the present invention, a thermistor or a thermostat can be arranged at a position facing the center of the coil that most easily generate heat. Particularly, the inside of the heating member is an ideal arrangement position since the thermostat can preferably act even when it is not driven. By comprising the temperature controller for controlling the operation of the coil based on the response result of such a temperature responding element, the heating member can be precisely temperature controlled to a temperature suitable for a fixing process.

In the above construction, the shielding member is preferably made of copper. Since copper has small electrical resistance and low magnetic permeability, a good magnetic shielding effect can be exhibited by using this as the material of the shielding member.

The shielding member is preferably made of a nonmagnetic metal whose thickness is in a range of 0.5 mm to 3 mm. Specifically, since the shielding member efficiently shields magnetism by suppressing its own generation of Joule heat, it is necessary to set as small a specific resistance (electrical resistance) as possible for the shielding member. If the thickness is set as above, good electrical conductivity can be ensured and a sufficient magnetic shielding effect can be obtained by making the specific resistance of the shielding member sufficiently small, whereas the shielding member can be made lighter.

In the above construction, the coil may be arranged outside the heating member and the second core may be arranged inside the heating member. In this case as well, the magnetic shielding effects can be similarly exhibited by moving the shielding member to the shielding position and the retracted position inside the heating member, and a good warm-up environment can be similarly realized when no shielding is performed.

The present invention has been appropriately and sufficiently described above by way of the embodiment with reference to the drawings, but it should be appreciated that a person skilled in the art can easily modify and/or improve the above embodiment. Accordingly, a modified embodiment or improved embodiment carried out by the person skilled in the art should be interpreted to be embraced by the scope as claimed unless departing from the scope as claimed.

This application is based on Japanese Patent Application Nos. 2008-000432 and 2008-003203 filed on Jan. 7, 2008 and Jan. 10, 2008, respectively, the contents of which are hereby incorporated by reference.

What is claimed is:

1. An image forming apparatus, comprising:

an image forming station for transferring a toner image to a sheet; and a fixing unit including a heating member that at least partially has an arcuate outer surface and a pressing member, the fixing unit being adapted to convey the sheet while sandwiching the sheet between the heating member and the pressing member and to fix the toner image to the sheet by heat at least from the heating member in a conveyance process, wherein the fixing unit includes:

a coil for generating a magnetic field for induction heating the heating member, the coil being arranged on a virtual arcuate surface extending along, outside and concentric with the arcuate outer surface of the heating member;

a first core made of a magnetic material and fixedly arranged around the coil to form a magnetic path around the coil;

a second core made of a magnetic material, arranged between the first core and the heating member along the magnetic path and capable of changing a posture thereof by being rotated about a longitudinal axis intersecting a passing direction of the magnetic field generated by the coil, the second core having a tubular or cylindrical shape centered on the longitudinal axis;

a shielding member made of a nonmagnetic metal and being curved along the outer surface of the second core to shield the magnetic field generated by the coil; and a magnetic shielding portion including a rotating mechanism for rotating the second core about the longitudinal axis and thereby changing the posture of the second core between a first posture where the shielding member shields the magnetism and a second posture where the shielding member does not shield the magnetism, wherein a relationship of $r1 \geqq r2$ holds if r1 denotes a radius of curvature of the virtual arcuate surface on which the coil is arranged and r2 denotes a shortest distance from a center of curvature of the arcuate outer surface of the heating member to the outer surface of the shielding member with the second core set in the first posture.

2. An image forming apparatus according to claim 1, wherein:

the coil is arranged along the outer surface of the heating member;

the first core is spaced apart from the heating member with the coil located therebetween and includes an entrance and an exit of the magnetic path;

the second core is a member capable of forming an intermediate magnetic path between the entrance or exit of the magnetic path and the heating member; and at least a part of the intermediate magnetic path is blocked by the shielding member when the second core is in the first posture while the intermediate magnetic path is not substantially blocked when the second core is in the second posture.

3. An image forming apparatus according to claim 1, further comprising a controller for changing a magnetic shielding amount by the shielding member by controlling a rotation amount of the second core by the rotating mechanism.

4. An image forming apparatus according to claim 1, wherein:

the heating member has a first area defining a maximum sheet passing area and being induction-heated by the coil;

the second core extends in a direction of the longitudinal axis to form the magnetic path in an entire area in a width direction of the heating member; and the shielding member is disposed outside a second area defining a minimum sheet passing area in the longitudinal axis direction of the second core.

5. An image forming apparatus according to claim 4, wherein if a ratio of the length of the shielding member to the outer circumferential length of the second core in a rotating direction of the second core is a covering ratio, the covering ratio preferably differs in the longitudinal axis direction and is set relatively smaller near the second area.

6. An image forming apparatus according to claim 1, wherein a relationship of $\theta 2 \geqq \theta 1$ holds if $\theta 1$ denotes an angle between a virtual straight line connecting the center of curvature of the arcuate outer surface of the heating member and a center of the second core and a straight line connecting the center of the second core and an intersection of the outer surface of the second core and the virtual arcuate surface on which the coil is arranged and $\theta 2$ denotes an angle between the virtual straight line and a straight line connecting the center of the second core and an end point of the shielding member with the shielding member set in the first posture.

7. An image forming apparatus according to claim 6, wherein:

the first core is formed with a virtual plane orthogonal to a virtual line connecting the center of curvature of the arcuate outer surface of the heating member and the center of the second core at the center of the second core as a center; and the end point of the shielding member in a circumferential direction of the second core is set at a position more distant from the arcuate outer surface of the heating member than the virtual plane with the second core set in the second posture.

8. An image forming apparatus according to claim 1, further comprising a temperature controller for controlling an induction heated state of the heating member by the coil, wherein:

the temperature controller includes a temperature responding element arranged along the inner circumferential surface of the heating member for responding to the temperature of the heating member; and the operation of the coil is controlled based on a response result of the temperature responding element.

9. An image forming apparatus according to claim 1, wherein the shielding member is made of copper.

10. An image forming apparatus according to claim 1, wherein the shielding member is made of a nonmagnetic metal whose thickness is in a range of 0.5 mm to 3 mm.

11. An image forming apparatus, comprising:

an image forming station for transferring a toner image to a sheet; and a fixing unit including a heating member and a pressing member and adapted to convey the sheet while sandwiching the sheet between the heating member and the pressing member and to fix the toner image to the sheet by heat at least from the heating member in a conveyance process, wherein the fixing unit includes:

a coil for generating a magnetic field for induction heating the heating member;

a first core made of a magnetic material and fixedly arranged around the coil to form a magnetic path around the coil;

a second core made of a magnetic material, arranged between the first core and the heating member along the magnetic path and capable of changing a posture thereof;

a shielding member made of a nonmagnetic metal and being arranged along the outer surface of the second core to shield the magnetic field generated by the coil, the shielding member having a closed frame portion; and a magnetic shielding portion for changing the posture of the second core between a first posture where the shielding member shields the magnetism and a second posture where the shielding member does not shield the magnetism, wherein the magnetic field generated by the coil penetrates through the closed frame portion of the shielding member when the second core is in the first posture while passing the outside the closed frame portion of the shielding member when the second core is in the second posture.

12. An image forming apparatus according to claim 11, wherein:

the second core is a member which changes its posture by being rotated about a longitudinal axis intersecting with a passing direction of the magnetic field generated by the coil; and the magnetic shielding portion includes a rotating mechanism for changing the posture of the second core between the first posture and second posture by rotating the second core about the longitudinal axis.

13. An image forming apparatus according to claim 11, wherein:

the second core changes the posture thereof by being rotated about a longitudinal axis intersecting with a passing direction of the magnetic field generated by the coil; and the magnetic shielding portion includes a rotating mechanism for changing the posture of the second core between the first and second postures by rotating the second core about the longitudinal axis.

14. An image forming apparatus according to claim 11, wherein:

the shielding member has one rectangular frame shape with a common outer peripheral part; and the inside of the rectangular frame is divided into a plurality of parts in the longitudinal direction of the heating member.

15. An image forming apparatus according to claim 11, wherein:

the coil is arranged along the outer surface of the heating member;

the first core is arranged while being divided into parts at the opposite sides of a center along the outer surface of the coil; and the second core is arranged at a position where magnetic paths join at the center of the coil via the divided parts of the first core.

16. An image forming apparatus according to claim 15, wherein:

the heating member at least partially has an arcuate outer surface;

the coil is arranged on a virtual arcuate surface extending along, outside and concentric with the arcuate outer surface of the heating member;

the second core has a tubular or cylindrical shape; that the shielding member is arcuately curved along the outer surface of the second core; and a relationship of $r1>r2$ holds if $r1$ denotes a radius of curvature of the virtual arcuate surface on which the coil is arranged and $r2$ denotes a shortest distance from a center of curvature of the arcuate outer surface of the heating member to the outer surface of the shielding member with the shielding member switched to the shielding position.

17. An image forming apparatus according to claim 16, wherein the virtual arcuate surface on which the coil is arranged is located at a position near an end point of the shielding member in a circumferential direction of the second core with the second core set in the first posture.

18. An image forming apparatus according to claim 16, wherein the first core is located at a position closer to the heating member than an end point of the shielding member in the circumferential direction of the second core with the second core set in the second posture.

* * * * *